US008073687B2

(12) United States Patent
Suzuki et al.

(10) Patent No.: US 8,073,687 B2
(45) Date of Patent: Dec. 6, 2011

(54) AUDIO REGENERATION METHOD

(75) Inventors: Masanao Suzuki, Kawasaki (JP); Miyuki Shirakawa, Fukuoka (JP); Yoshiteru Tsuchinaga, Fukuoka (JP); Takashi Makiuchi, Fukuoka (JP)

(73) Assignee: Fujitsu Limited, Kawasaki (JP)

( * ) Notice: Subject to any disclaimer, the term of this patent is extended or adjusted under 35 U.S.C. 154(b) by 756 days.

(21) Appl. No.: 12/232,096

(22) Filed: Sep. 10, 2008

(65) Prior Publication Data

US 2009/0070120 A1 Mar. 12, 2009

(30) Foreign Application Priority Data

Sep. 12, 2007 (JP) ..... 2007-237217

(51) Int. Cl.
*G10L 19/00* (2006.01)

(52) U.S. Cl. ..... 704/220

(58) Field of Classification Search ..... 704/200–230
See application file for complete search history.

(56) References Cited

U.S. PATENT DOCUMENTS

| | | | | |
|---|---|---|---|---|
| 7,769,584 | B2 * | 8/2010 | Oshikiri et al. | 704/230 |
| 7,983,904 | B2 * | 7/2011 | Ehara et al. | 704/205 |
| 8,010,352 | B2 * | 8/2011 | Son et al. | 704/223 |
| 2005/0267744 | A1 | 12/2005 | Nettre et al. | |

FOREIGN PATENT DOCUMENTS

JP 2005-338637 12/2005

* cited by examiner

*Primary Examiner* — Abul K Azad
(74) *Attorney, Agent, or Firm* — Staas & Halsey LLP

(57) ABSTRACT

According to an aspect of an embodiment, a method for regenerating an audio signal including a low frequency component and a high frequency component by decoding a coded data including a first coded data and a second coded data, the method comprising the steps of: generating the low frequency component; generating the high frequency component; determining whether the low frequency component has transient characteristics or not; generating a low frequency correction component by removing a stationary component when the audio signal has the transient characteristics; generating a corrected high frequency component by correcting the high-frequency component on the basis of the duration of the low frequency correction component when the audio signal has the transient characteristics; and regenerating the audio signal by synthesizing the low frequency component with the corrected high-frequency component.

12 Claims, 21 Drawing Sheets

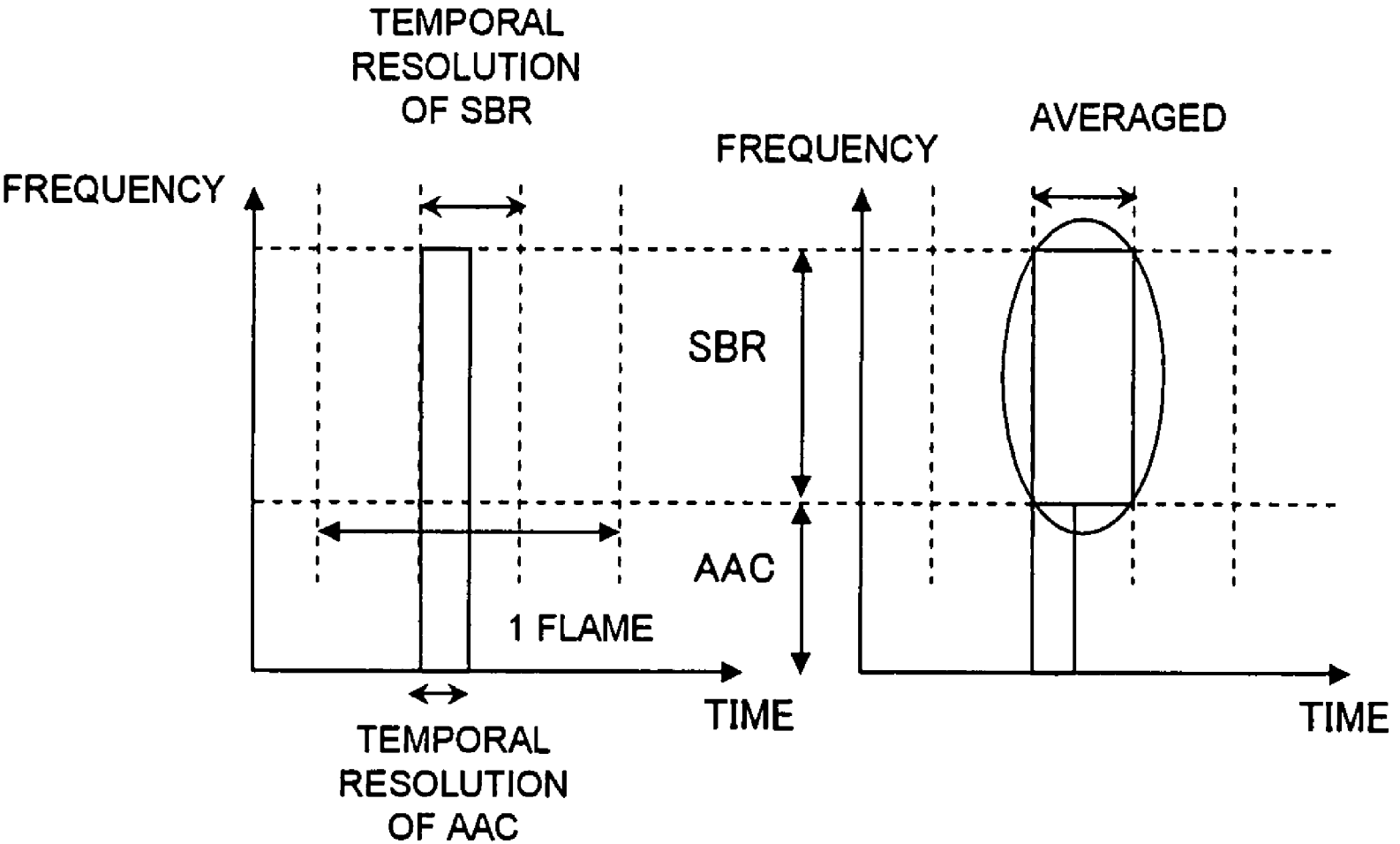
Fig. 21A ATTACK SOUND
Fig. 21B DECORDED SPECTRUM

AUDIO REGENERATION METHOD

BACKGROUND OF THE INVENTION

1. Field of the Invention

The present invention relates to a decoding apparatus, a decoding method, and a decoding program for decoding a low-frequency component from a first coded data obtained by coding a low-frequency component in an audio signal, and decoding the high-frequency component of the audio signal from a second coded data that is used to decode a high-frequency component in the audio signal and the low-frequency component.

2. Description of the Related Art

In recent years, in order to code audio or music, High-Efficiency Advanced Audio Coding (HE-AAC) has been used. The HE-AAC format is an audio compression format mainly used in Moving Picture Experts Group phase 2 (MPEG-2), or Moving Picture Experts Group phase 4 (MPEG-4).

In the HE-AAC, a low-frequency component in a frequency of an audio signal (signal relating to audio, music, etc.) to be coded is coded according to Advanced Audio Coding (AAC), and a high-frequency component in the frequency is coded according to Spectral Band Replication (SBR). In the SBR format, the high-frequency component in the frequency of the audio signal can be coded using smaller number of bits than that used in the other formats by coding only a part that is hard to predict from the low-frequency component in the frequency of the audio signal. Hereinafter, the data coded according to the AAC format is referred to as AAC data, and the data coded according to the SBR format is referred to as SBR data.

Now, an example of a decoder that decodes data (hereinafter, referred to as HE-AAC data) coded according to the HE-AAC format is described. FIG. 19 is a functional block diagram illustrating a configuration of a known decoder. As illustrated in FIG. 19, a decoder 10 includes a data separation section 11, an AAC decoding section 12, an analysis filter section 13, a high-frequency generation section 14, and synthesis filter section 15.

The data separation section 11 is a processing section that when HE-AAC data is acquired, separates AAC data and SBR data contained in the acquired HE-AAC data respectively, outputs the ACC data to the AAC decoding section 12, and outputs the SBR data to the high-frequency generation section 14.

The AAC decoding section 12 is a processing section that decodes AAC data and outputs the decoded AAC data as AAC output audio data to the analysis filter section 13. The analysis filter section 13 is a processing section that calculates a characteristic between time necessary for the low-frequency component in the audio signal and a frequency based on the ACC audio data acquired from the AAC decoding section 12, and outputs the calculation result to the synthesis filter section 15 and the high-frequency generation section 14. Hereinafter, the calculation result outputted from the analysis filter section 13 is referred to as low-frequency component data.

The high-frequency generation section 14 is a processing section that generates a high-frequency component in the audio signal based on the SBR data acquired from the data separation section 11 and the low-frequency component data acquired from the analysis filter section 13. Further, the high-frequency generation section 14 outputs the data of the generated high-frequency component as high-frequency component data to the synthesis filter section 15.

The synthesis filter section 15 is a processing section that synthesizes the low-frequency component data acquired from the analysis filter section 13 with the high-frequency component data acquired from the high-frequency generation section 14 and outputs the synthesized data as HE-AAC output audio data.

FIG. 20 is a view for outlining a processing performed in the decoder 10. As illustrated in FIG. 20, the decoder 10 replicates a part of low-frequency component data, and adjusts an electric power of the replicated data to generate high-frequency component data. Then, the decoder 10 synthesizes the low-frequency component data with the high-frequency component data to generate HE-AAC output audio data. As described above, the HE-AAC data (audio signal, etc.) that is coded according to the HE-AAC format is decoded as the HE-AAC output audio data by the decoder 10.

In Japanese Laid-open Patent Publication No. 2005-338637, a technique for improving auditory quality is disclosed. In the technique, a value of a scale factor in an audio signal is adjusted to correct a mismatch between powers of the audio signal before coding and after coding.

However, the above-described known technique cannot solve a problem that after an audio signal that contains an attack sound (signal that has a sharp amplitude change) is coded, when the coded audio signal is decoded, it is not possible to appropriately decode a high-frequency component in a frequency of the audio signal.

The problem in the known technique is specifically described. FIGS. 21A and 21B are views for explaining the problem in the known technique. As illustrated in FIGS. 21A and 21B, in a case where an audio signal that contains an attack sound whose amplitude sharply changes in an extremely short duration is coded according to the SBR format, because of characteristics in the SBR format, a time domain where the attack sound is generated can be extremely short (or, a temporal resolution in the SBR format becomes poorer than that in the AAC format) as compared to a time domain divided according to the SBR format. Then, the power in the time domain that contains the attack signal is averaged, and the attack sound is coded in a state the attack sound is temporally extended.

That is, it is very important problem to be solved to correct the high-frequency component in the coded audio signal and appropriately decode the audio signal even if the high-frequency component in the audio signal containing the attack signal is not appropriately coded according to the HE-AAC format. Especially, it is important to accurately correct the duration of the attack sound contained in the high-frequency components even if a steady component other than the attack sound exists in the low-frequency components that are coded according to the AAC format.

SUMMARY

According to an aspect of an embodiment, a method for regenerating an audio signal including a low frequency component and a high frequency component by decoding a coded data including a first coded data and a second coded data, the method comprising the steps of: generating the low frequency component; generating the high frequency component; determining whether the low frequency component has transient characteristics or not; generating a low frequency correction component by removing a stationary component when the audio signal has the transient characteristics; generating a corrected high frequency component by correcting the high-frequency component on the basis of the duration of the low frequency correction component when the audio signal has the transient characteristics; and regenerating the audio signal by synthesizing the low frequency component with the corrected high-frequency component.

BRIEF DESCRIPTION OF THE DRAWINGS

FIGS. 21A and 21B is views for explaining a problem in a known technique.

DESCRIPTION OF THE PREFERRED EMBODIMENTS

Preferred embodiments of a decoding apparatus, decoding method, and decoding program according to the present invention will be described in detail with reference to the attached drawings.

First Embodiment

Figures 1A, 1B, 1C:
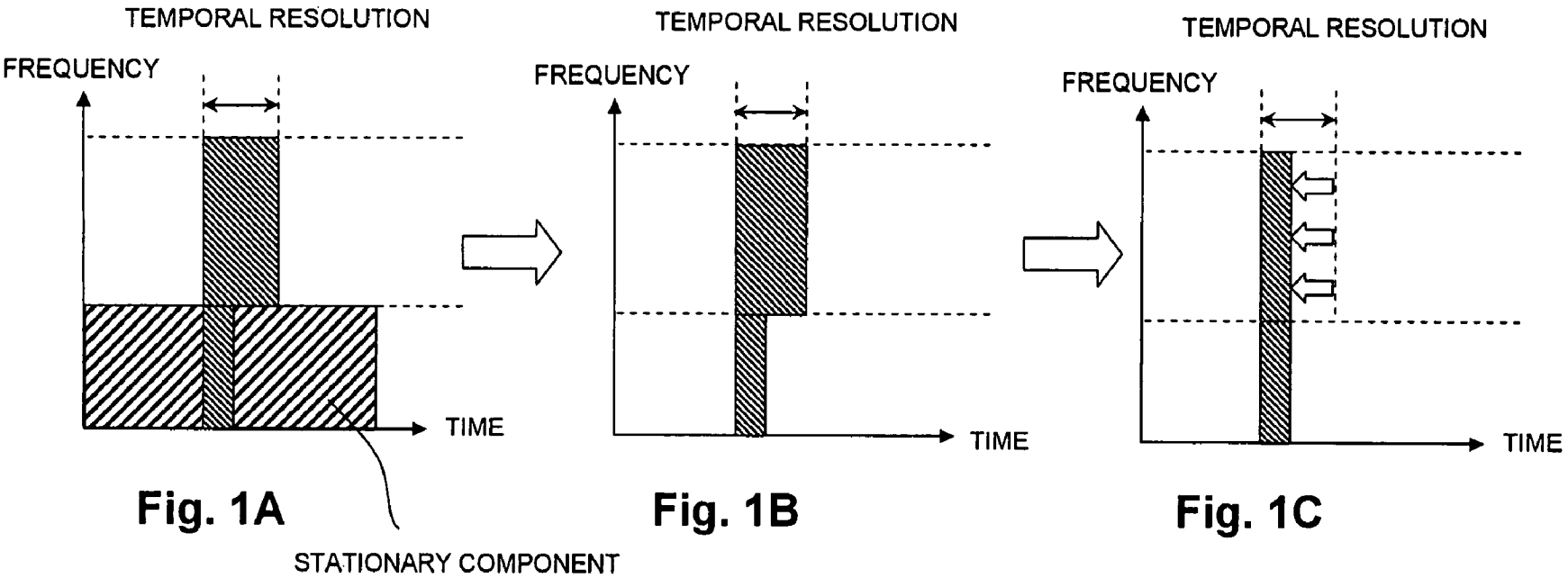
FIGS. 1A to 1C are views for illustrating outlines and features of a decoder according to a first embodiment of the present invention.

First, an outline and features of a decoder according to a first embodiment is described. FIGS. 1A to 1*c* are views for illustrating outlines and features of the decoder according to the first embodiment of the present invention. The decoder according to the first embodiment decodes coded audio signal using AAC data obtained by coding a low-frequency component in an audio signal according to the AAC format, and SBR data obtained by coding a high-frequency component in the audio signal according to the SBR format (that is, the decoder decodes the coded audio signal using the HE-AAC format).

Especially, if the audio signal contains an attack sound (in a case where the audio signal has transient characteristics), the decoder according to the first embodiment removes a stationary component contained in the low-frequency component data obtained by decoding the AAC data, corrects a duration of the high-frequency component data (high-frequency component data in the audio signal that is generated using the low-frequency component data and the SBR data) to match with a duration of the low-frequency component data (corrected low-frequency data) from which the stationary component is removed, and synthesizes the corrected high-frequency component data (corrected high-frequency data) with the low-frequency component data to decode the audio signal (see FIGS. 1A to 1C).

As described above, the decoder according to the first embodiment removes the stationary component in the low-frequency component data, corrects the high-frequency component data to match with the duration of the low-frequency component data, and synthesizes the corrected high-frequency data with the low-frequency component data to decode the audio signal. Accordingly, if the audio signal that contains the sound source having the strong transient characteristics such as the attack sound is decoded, it can be prevented that the attack sound temporally extends, and deterioration in the sound quality of the audio signal can be prevented.

Further, the decoder according to the first embodiment removes the stationary component contained in the low-frequency component data, and corrects the high-frequency component data to match with the duration of the low-frequency component data from which the stationary component is removed. Accordingly, the duration of the high-frequency component data can be accurately corrected.

Figure 2:
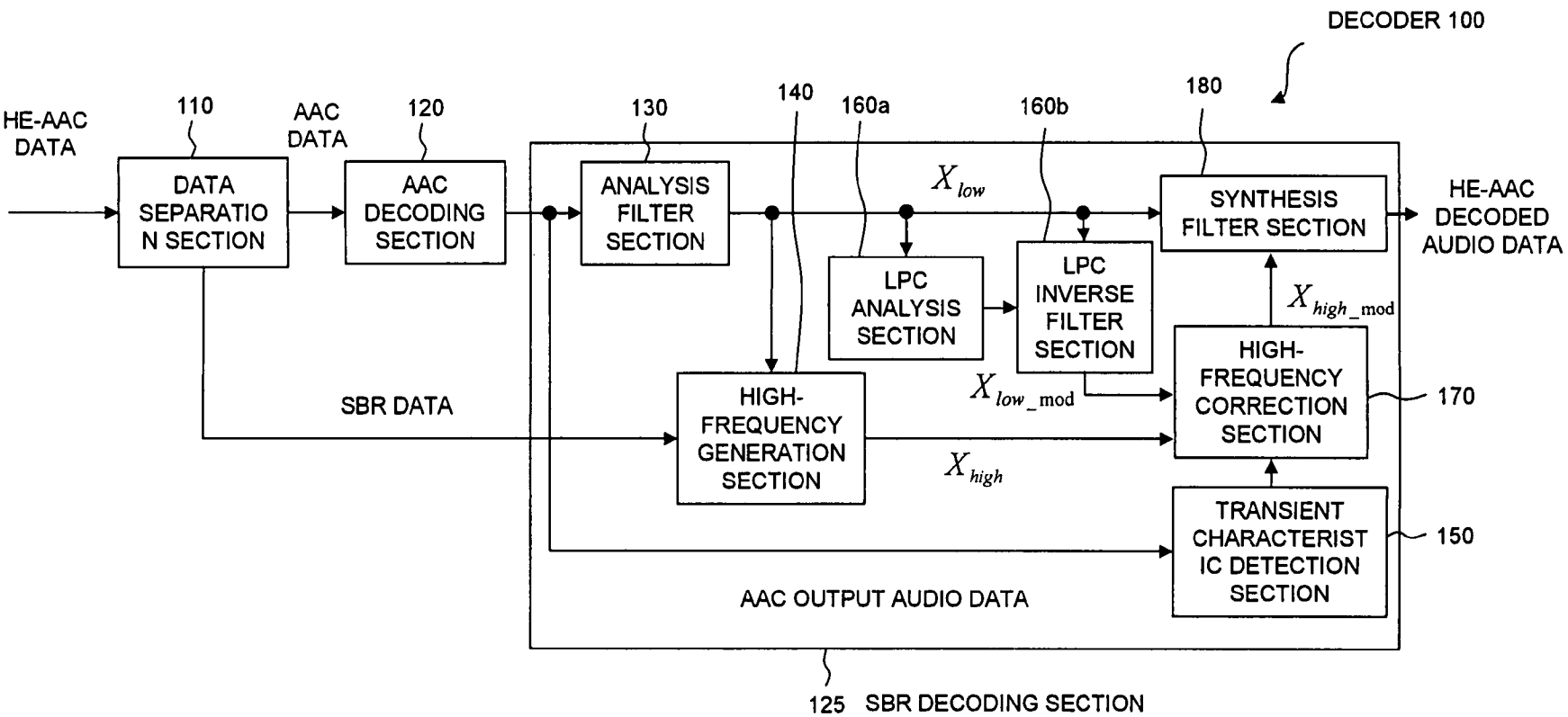
FIG. 2 is a view illustrating a configuration of a decoder according to a first embodiment of the present invention.

Now, a configuration of the decoder according to the first embodiment is described. FIG. 2 is a view illustrating a configuration of a decoder 100 according to a first embodiment of the present invention. As illustrated in FIG. 2, the decoder 100 includes a data separation section 110, an AAC decoding section 120, and an SBR decoding section 125. The SBR decoding section 125 includes an analysis filter section 130, a high-frequency generation section 140, a transient characteristic detection section 150, an LPC analysis section 160*a*, an LPC inverse filter section 160*b*, a high-frequency correction section 170, and a synthesis filter section 180.

The data separation section 110 is a processing section that, when HE-AAC data (audio signal coded according to the HE-AAC format) is acquired, separates AAC data and SBR data contained in the acquired HE-AAC data respectively, outputs the AAC data to the AAC decoding section 120, and outputs the SBR data to the high-frequency generation section 140.

The AAC decoding section 120 is a processing section that decodes the AAC data acquired from the data separation section 110, and outputs the decoded AAC data as AAC output audio data to the analysis filter section 130 and the transient characteristic detection section 150. The AAC output audio data indicates a characteristic of time and an electric power (power) in the low-frequency component in the audio signal.

Figure 3:
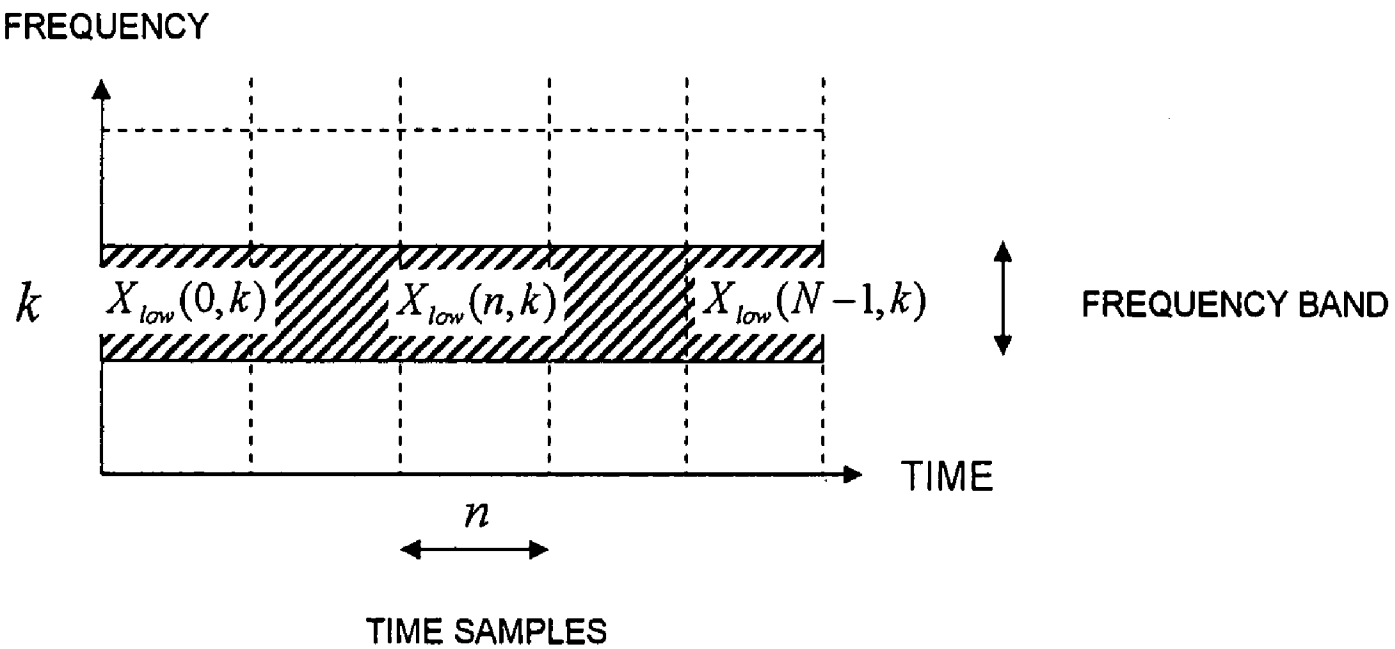
FIG. 3 is a view illustrating low-frequency component data.

The analysis filter section 130 is a processing section that calculates a characteristic of a time period and a frequency for a low-frequency component in the audio signal based on the AAC output audio data acquired from the AAC decoding section 120, and outputs the calculated result to the LPC analysis section 160*a*, the LPC inverse filter section 160*b*, and the synthesis filter section 180. Hereinafter, the calculation result outputted from the analysis filter section 130 is referred to as low-frequency component data. FIG. 3 is a view illustrating the low-frequency component data. In embodiments of the present invention, in order to remove a stationary component in the low-frequency component data, LPC an analysis is performed on each frequency band (32 bands in a case of the HE-AAC) in the low-frequency component data.

The high-frequency generation section 140 is a processing section that generates a high-frequency component of the audio signal based on SBR data acquired from the data separation section 110 and low-frequency component data acquired from the analysis filter section 130. The high-frequency generation section 140 outputs the generated data of the high-frequency component (hereinafter, referred to as high-frequency component data) to the high-frequency correction section 170.

The transient characteristic detection section 150 is a processing section that acquires AAC output audio data from the AAC decoding section 120 and determines whether an attack sound is contained in the HE-AAC data based on the acquired AAC output audio data (determines whether the HE-AAC data has transient characteristics or not).

Figure 4:
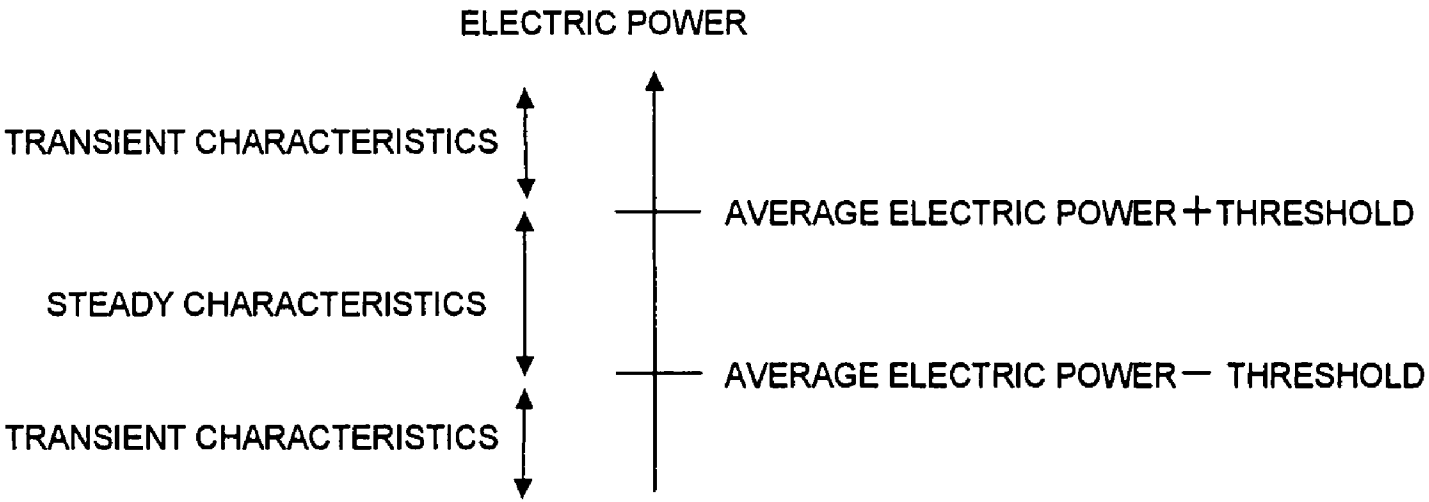
FIG. 4 is a view illustrating a processing performed in a transient characteristic detection section.

Now, a processing performed in the transient characteristic detection section 150 is specifically described. FIG. 4 is a view illustrating a processing performed in the transient characteristic detection section 150. The transient characteristic detection section 150 stores a plurality of pieces of AAC output audio data acquired in the past in a storage section (not shown), calculates an average electric power of each piece of AAC output audio data stored in the storage section, and stores the calculation results. Further, the transient characteristic detection section 150 calculates a value by adding a predetermined threshold to the average electric power and a value by subtracting a predetermined threshold from the average electric power, and stores the values.

When the AAC output audio data is acquired, the transient characteristic detection section 150 compares the electric power of the acquired AAC output audio data, the value obtained by the addition and the value obtained by the subtraction with each other, and determines whether the HE-AAC data has transient characteristics or not. If the electric power of the AAC output audio data is equal to the value obtained by the addition or more and less than the value obtained by the subtraction, the transient characteristic detection section 150 determines that the HE-AAC has transient characteristics. If the electric power of the AAC output audio data is equal to the value obtained by the subtraction or more and less than the value obtained by the addition, the transient characteristic detection section 150 determines that the HE-AAC has steady characteristics (see FIG. 4). Then, the transient characteristic detection section 150 outputs the determination result to the high-frequency correction section 170.

The LPC analysis section 160*a* is a processing section that acquires the low-frequency component data from the analysis filter section 130, performs an LPC analysis on the acquired low-frequency component data, and calculates an LPC coefficient. If a frequency band of the low-frequency component data is k (see FIG. 3), the LPC analysis is performed on $X_{low}(0, k)$, $X_{low}(1, k) \ldots, X_{low}(N-1,k)$ to calculate an LPC coefficient $\alpha_i(k)$ ($_i$=1, . . . , p).

The N denotes the number of time samples of a current frame (low-frequency component data). The p denotes a maximum order of an LPC coefficient. To calculate the LPC coefficient, known methods such as Levinson-Durbin algorithm or a covariance method can be used. In a case where the low-frequency component data is a complex number, the above-described LPC analysis is performed on a real part and an imaginary part of the low-frequency component data respectively.

The LPC inverse filter section 160*b* is a processing section that acquires low-frequency component data from the analysis filter section 130 and generates corrected low-frequency data by removing a stationary component from the low-frequency component data using an LPC coefficient acquired from the LPC analysis section 160*a*.

For example, if a maximum order of an LPC coefficient is 2 (p=2), a real part and an imaginary part in corrected low-frequency data (equations of an inverse filter of the real part and the imaginary part) can be represented as the following equations.

[Equation 1]

$$Re\{X_{low_mod}(k,n)\}=Re\{X(k,n)\}+\alpha_{r,1}(k)\cdot Re\{X(k,n-1)\}+\alpha_{r,2}(k)\cdot Re\{X(k,n-2)\} \quad (1)$$

[Equation 2]

$$Im\{X_{low_mod}(k,n)\}=Im\{X(k,n)\}\alpha_{i,1}(k)\cdot Im\{X(k,n-1)\}+\alpha_{i,2}(k)\cdot Im\{X(k,n-2)\} \quad (2)$$

If the LPC analysis is performed on a frequency domain in low-frequency component data, a prediction gain of a stationary component is adequate. However, a prediction gain of low-frequency components other than the stationary component is not adequate. Accordingly, if the above-described equations of the inverse filter shown in the equation (1) and the equation (2) are used, only the stationary component whose prediction gain is adequate is removed from the low-frequency component data.

In the above-described description, it is assumed that the maximum order of the LPC coefficient is 2. However, the maximum order of the LPC coefficient can be 2 or more. Further, it is possible to remove the stationary component of the low-frequency component data only from a band where an average electric power of a frequency band of the low-frequency component data is equal to a threshold or more. Further, in the above description, it is assumed that the low-frequency component data is a complex number. However, in a case where the low-frequency component data is a real number, a similar processing can be performed only on a real part.

The high-frequency correction section 170 is a processing section that acquires a determination result from the transient characteristic detection section 150. If the HE-AAC data has transient characteristics, the high-frequency correction section 170 corrects high-frequency component data based on a duration of the corrected low-frequency data. The high-frequency correction section 170 outputs the corrected high-frequency component data (corrected high-frequency data) to the synthesis filter section 180. If the HE-AAC data does not have transient characteristics, the high-frequency correction section 170 directly outputs the high-frequency component data acquired from the high-frequency generation section 140 to the synthesis filter section 180 as corrected high-frequency data.

Figure 5:
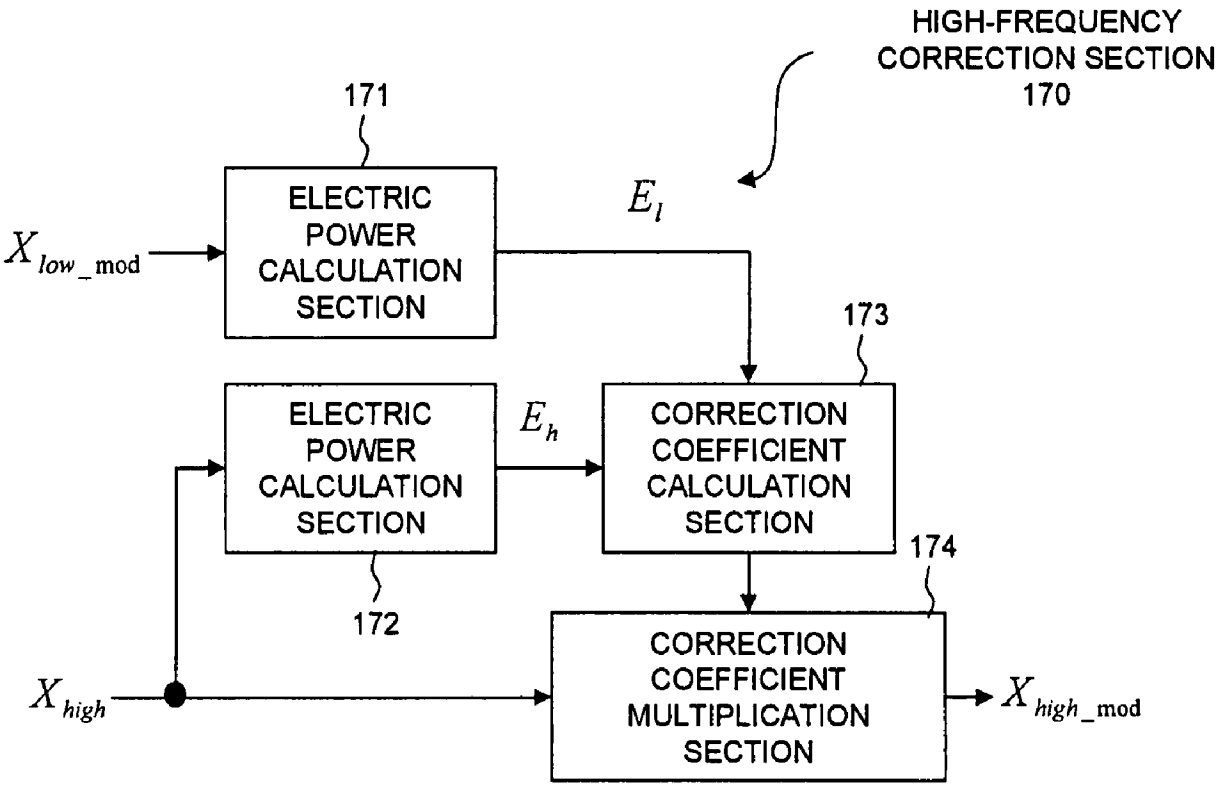
FIG. 5 is a view illustrating a configuration of a high-frequency correction section.

FIG. 5 is a view illustrating a configuration of the high-frequency correction section 170. As illustrated in FIG. 5, the high-frequency correction section 170 includes electric power calculation sections 171 and 172, a correction coefficient calculation section 173, and a correction coefficient multiplication section 174.

The electric power calculation section 171 is a processing section that converts corrected high-frequency data acquired from the LPC inverse filter section 160*b* into an electric power. An electric power $E_1$ converted by the electric power calculation section 171 can be represented as follows.

[Equation 3]

$$E_1(n,k)=Re\{X_{low_mod}(n,k)\}^2+Im\{X_{low_mod}(n,k)\}^2 \quad (3)$$

The electric power calculation section 171 outputs the converted electric power $E_1$ to the correction coefficient calculation section 173.

The electric power calculation section 172 is a processing section that converts high-frequency component data acquired from the high-frequency generation section 140 into an electric power. An electric power $E_h$ converted by the electric power calculation section 172 can be represented as follows.

[Equation 4]

$$E_h(n,k)=Re\{X_{high}(n,k)\}^2+Im\{X_{high}(n,k)\}^2 \quad (4)$$

Figure 6:
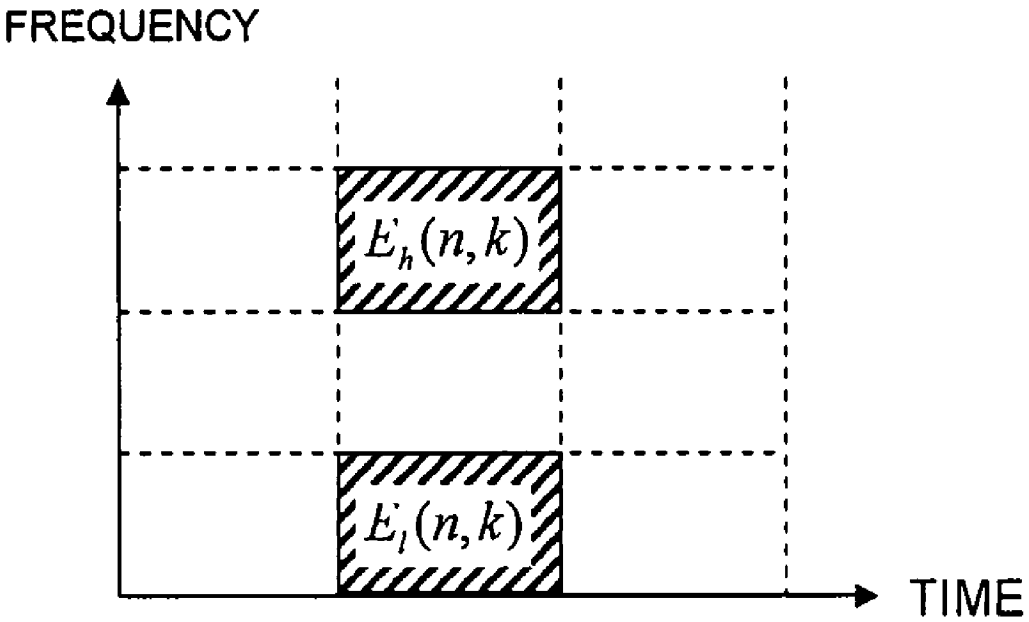
FIG. 6 is a view illustrating electric powers $E_1$ and $E_h$ on a time-frequency axis.

The electric power calculation section 172 outputs the converted electric power $E_h$ to the correction coefficient calculation section 173. The electric powers $E_1$ and $E_h$ converted by the electric power calculation sections 171 and 172 are shown on a time-frequency axis as illustrated in FIG. 6. FIG. 6 is a view illustrating the electric powers $E_1$ and $E_h$ on the time-frequency axis.

Figure 7:
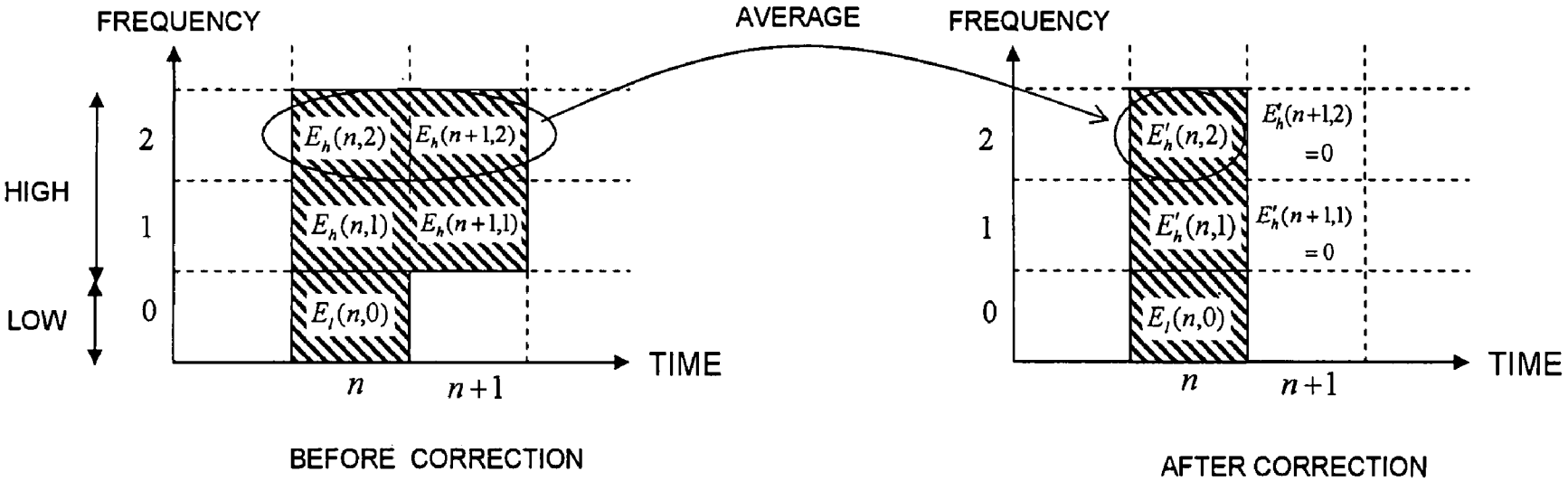
FIG. 7 is a view illustrating a method for calculating a correction coefficient.

The correction coefficient calculation section 173 is a processing section that calculates a correction coefficient for correcting high-frequency component data based on the $E_1$ and $E_h$ acquired from the electric power calculation sections 171 and 172. FIG. 7 is a view illustrating a method for calculating the correction coefficient.

As illustrated in FIG. 7, if a low frequency exists only in time n, and high frequencies exist in the time n and time n+1, the electric power $E_1$ in the low frequency is not corrected. In the high frequencies, to match durations in the high frequencies with a duration in the low frequency, values of the electric powers in all time durations that exist before a correction are concentrated. An electric power $E'_h(n,1)$ in the high frequency in a frequency band "1" after the correction can be represented as follows.

[Equation 5]

$$E'_h(n,1)=E_h(n,1)+E_h(n+1,1) \quad (5)$$

An electric power $E'_h(n+1,1)$ in the high frequency in the frequency band "1" after the correction can be represented as follows.

[Equation 6]

$$E'_h(n+1,1)=0 \quad (6)$$

Similarly, an electric power $E'_h(n,2)$ in the high frequency in a frequency band "2" after the correction can be represented as follows.

[Equation 7]

$$E'_h(n,2)=E_h(n,2)+E_h(n+1,2) \quad (7)$$

An electric power $E'_h(n+1,2)$ in the high frequency in the frequency band "2" after the correction can be represented as follows.

[Equation 8]

$$E'_h(n+1,2)=0 \quad (8)$$

In the above description, the two durations n and n+1 are used. However, if two or more durations exist, a similar method for correcting an electric power in a high frequency can be employed.

The correction coefficient calculation section 173 calculates a correction coefficient gain using the electric power $E_h$ before correction and the electric power $E'_h$ after correction according to the following equation.

[Equation 9]

$$\text{gain}(n,k)=\sqrt{\frac{E'_h(n,k)}{E_h(n,k)}} \quad (9)$$

The correction coefficient calculation section 173 outputs the calculated correction coefficient to the correction coefficient multiplication section 174.

The correction coefficient multiplication section 174 is a processing section that acquires a correction coefficient from the correction coefficient calculation section 173, multiplies a real part and an imaginary part in high-frequency component data acquired from the high-frequency generation section 140 by the correction coefficient, and generates corrected high-frequency data that is corrected data of the high-frequency component data. A real part and an imaginary part in the corrected high-frequency data can be represented as follows.

[Equation 10]

$$Re\{X_{high_mod}\}=\text{gain}*Re\{X_{high}\} \quad (10)$$

[Equation 11]

$$Im\{X_{high_mod}\}=\text{gain}*Im\{X_{high}\} \quad (11)$$

The correction coefficient multiplication section 174 outputs the corrected high-frequency data to the synthesis filter section 180.

The synthesis filter section 180 is a processing section that synthesizes low-frequency component data acquired from the analysis filter section 130 with corrected high-frequency data acquired from the high-frequency correction section 170 and outputs the synthesized data as HE-AAC decoded audio data.

Figure 8:
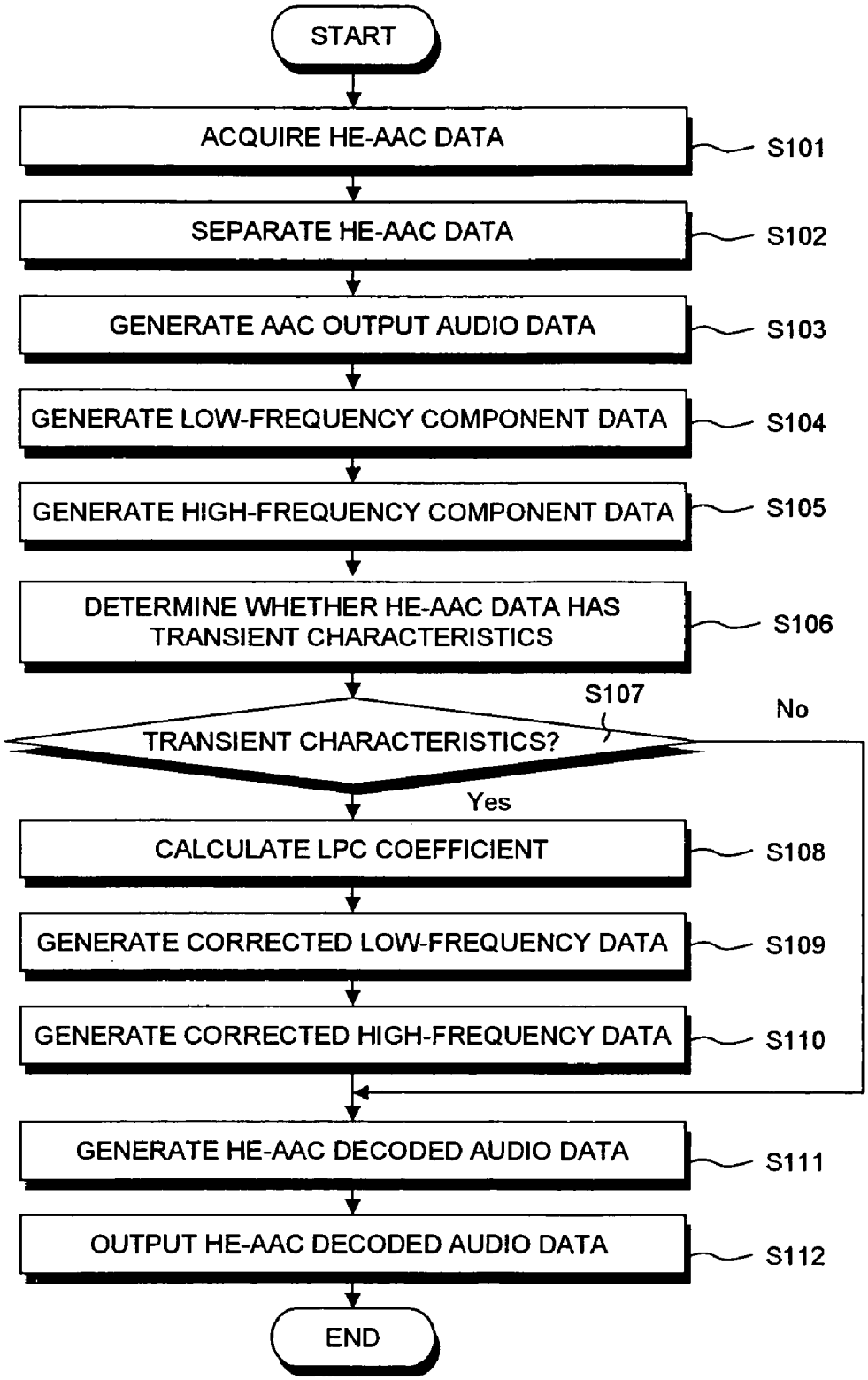
FIG. 8 is a flowchart illustrating a processing procedure performed in a decoder according to the first embodiment of the present invention.

Now, a processing procedure performed in the decoder 100 according to the first embodiment is described. FIG. 8 is a flowchart illustrating a processing procedure performed in the decoder 100 according to the first embodiment of the present invention. As illustrated in FIG. 8, in the decoder 100, the data separation section 110 acquires HE-AAC data (step S101), and separates the HE-AAC data into AAC data and SBR data (step S102).

Then, the AAC decoding section 120 generates AAC output audio data from the AAC data (step S103). The analysis filter section 130 generates low-frequency component data from the AAC output audio data (step S104). The high-frequency generation section 140 generates high-frequency component data from the SBR data and the low-frequency component data (step S105).

The transient characteristic detection section 150 determines whether the HE-AAC data has transient characteristics or not based on the AAC output audio data (step S106). If the transient characteristic detection section 150 determines that the HE-AAC data has stationarity (step S107: NO), the processing proceeds to step S111.

On the other hand, if the transient characteristic detection section 150 determines that the HE-AAC data has transient characteristics (step S107: YES), the LPC analysis section 160*a* performs an LPC analysis on the low-frequency component data, and calculates an LPC coefficient (step S108). The LPC inverse filter section 160*b* generates corrected low-frequency data based on the LPC coefficient (step S109).

The high-frequency correction section 170 corrects the high-frequency component data and generates corrected high-frequency data (step S110). The synthesis filter section 180 synthesizes the low-frequency component data with the corrected high-frequency data, generates HE-AAC decoded audio data (step S111), and outputs the HE-AAC decoded audio data (step S112).

As described above, the high-frequency correction section 170 corrects the high-frequency component data using the corrected low-frequency data from which the stationary component is removed. Accordingly, it can be prevented that the attack sound temporally extends, and deterioration in the sound quality of the audio signal can be prevented.

As described above, in the decoder 100 according to the first embodiment, if the transient characteristic detection section 150 determines that the HE-AAC data contains an attack sound, the LPC analysis section 160*a* and the LPC inverse filter section 160*b* remove a stationary component contained in the low-frequency component data. Then, the high-frequency correction section 170 generates corrected high-frequency data that is the data whose high-frequency component data is corrected to match with a duration of the corrected low-frequency component data. The synthesis filter section 180 synthesizes the low-frequency component data with the corrected high-frequency data and generates HE-AAC decoded audio data. Accordingly, if an audio signal that contains a sound source that has strong transient characteristics such as an attack sound is decoded, it can be prevented that the attack sound temporally extends, and deterioration in the sound quality of the audio signal can be prevented.

Further, in the decoder 100 according to the first embodiment, the high-frequency correction section 170 corrects high-frequency component data to match with a duration of corrected low-frequency data from which a stationary component of low-frequency component data is removed. Accordingly, it is possible to adjust a duration of the high-frequency component data to an optimal duration.

Second Embodiment

Now, a decoder according to a second embodiment of the present invention is described. The decoder according to the second embodiment determines whether an audio signal has transient characteristics or not based on window switch data contained in AAC data. It is assumed that the window switch data includes data of a determination result generated by an encoder for coding the audio signal by determining whether transient characteristics are contained in the audio signal or not.

Specifically, if the audio signal has transient characteristics, SHORT is set to window switch data. If the audio signal has stationarity, LONG is set to the window switch data. In AAC, the SHORT or LONG is set for each frame. Generally, in a case of a transient characteristic signal such as an attack sound, the SHORT is selected. In a state of the LONG, a temporal resolution is low, and in a state of the SHORT, the temporal resolution is high.

Accordingly, the decoder according to the second embodiment can determine whether an attack sound is contained in HE-AAC data by simply referring to the window switch data. Thus, it is not necessary to calculate an average electric power as described in the first embodiment, and processing loads of the decoder can be reduced.

Figure 9:
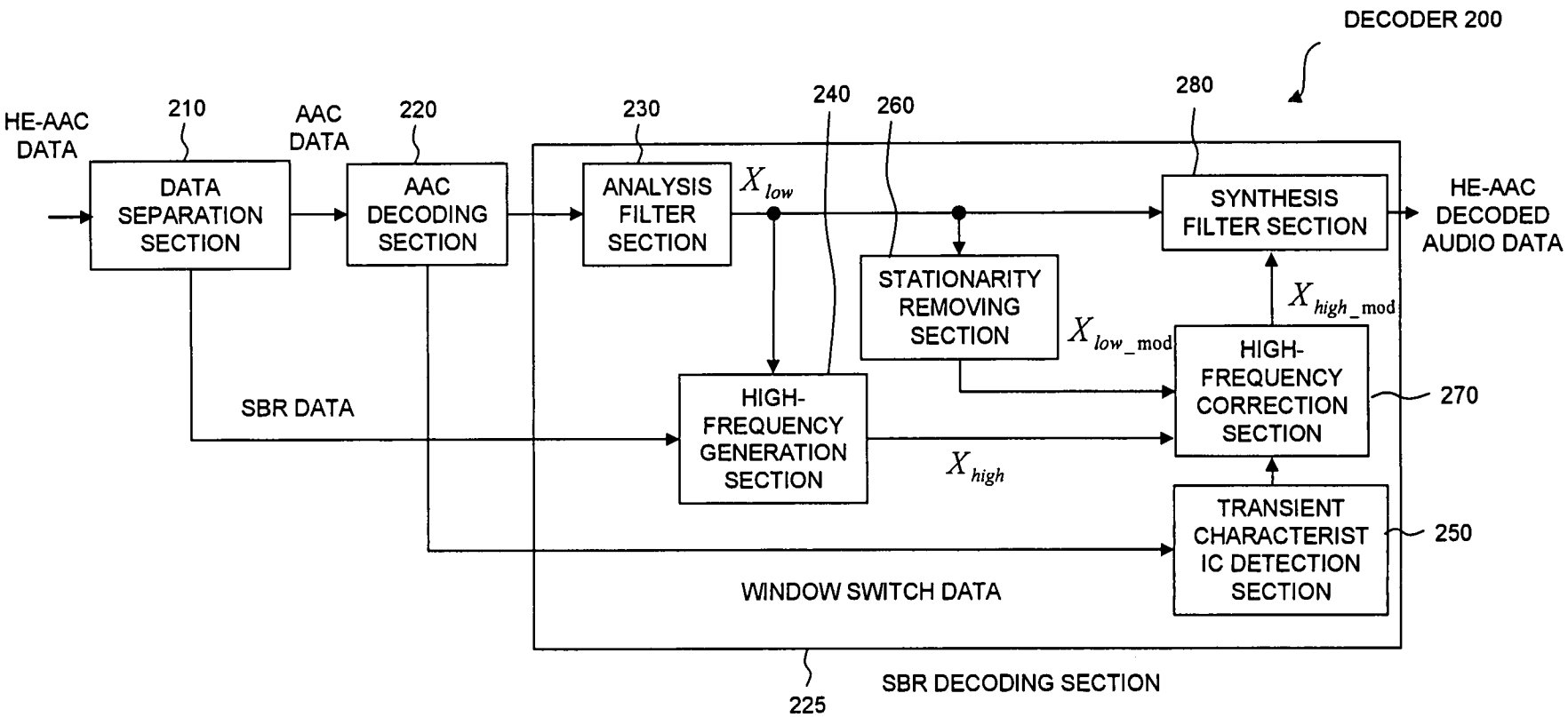
FIG. 9 is a view illustrating a configuration of a decoder according to a second embodiment of the present invention.

Next, a configuration of the decoder according to the second embodiment is described. FIG. 9 is a view illustrating a configuration of a decoder 200 according to the second embodiment of the present invention. As illustrated in FIG. 9, the decoder 200 includes a data separation section 210, an AAC decoding section 220, and an SBR decoding section 225. The SBR decoding section 225 includes an analysis filter section 230, a high-frequency generation section 240, a transient characteristic detection section 250, a stationarity removing section 260, a high-frequency correction section 270, and a synthesis filter section 280.

Since the data separation section 210, the analysis filter section 230, the high-frequency generation section 240, the high-frequency correction section 270, and the synthesis filter section 280 are similar to the data separation section 110, the analysis filter section 130, the high-frequency generation section 140, the high-frequency correction section 170, and the synthesis filter section 180 illustrated in FIG. 2, their descriptions are omitted.

The AAC decoding section 220 is a processing section that decodes AAC data acquired from the data separation section 210, and outputs the decoded AAC output audio data to the analysis filter section 230. Further, the AAC decoding section 220 extracts window switch data included in the decoded AAC data and outputs the extracted window switch data to the transient characteristic detection section 250.

The transient characteristic detection section 250 is a processing section that acquires window switch data from the AAC decoding section 220, determines whether the HE-AAC data has transient characteristics or not based on the acquired window switch data, and outputs the determination result to the high-frequency correction section 270.

Specifically, if the SHORT is set to the window switch data, the transient characteristic detection section 250 determines that the HE-AAC data has transient characteristics. If the LONG is set to the window switch data, the transient characteristic detection section 250 determines that the HE-AAC data has stationarity.

The stationarity removing section 260 is a processing section that performs an LPC analysis on low-frequency component data, and generates corrected low-frequency data by removing a stationary component contained in a low-frequency component. Since the stationarity removing section 260 performs similar processings as those in the LPC analysis section 160*a* and the LPC inverse filter section 160*b* described in the first embodiment, a detailed description of the stationarity removing section 260 is omitted.

Figure 10:
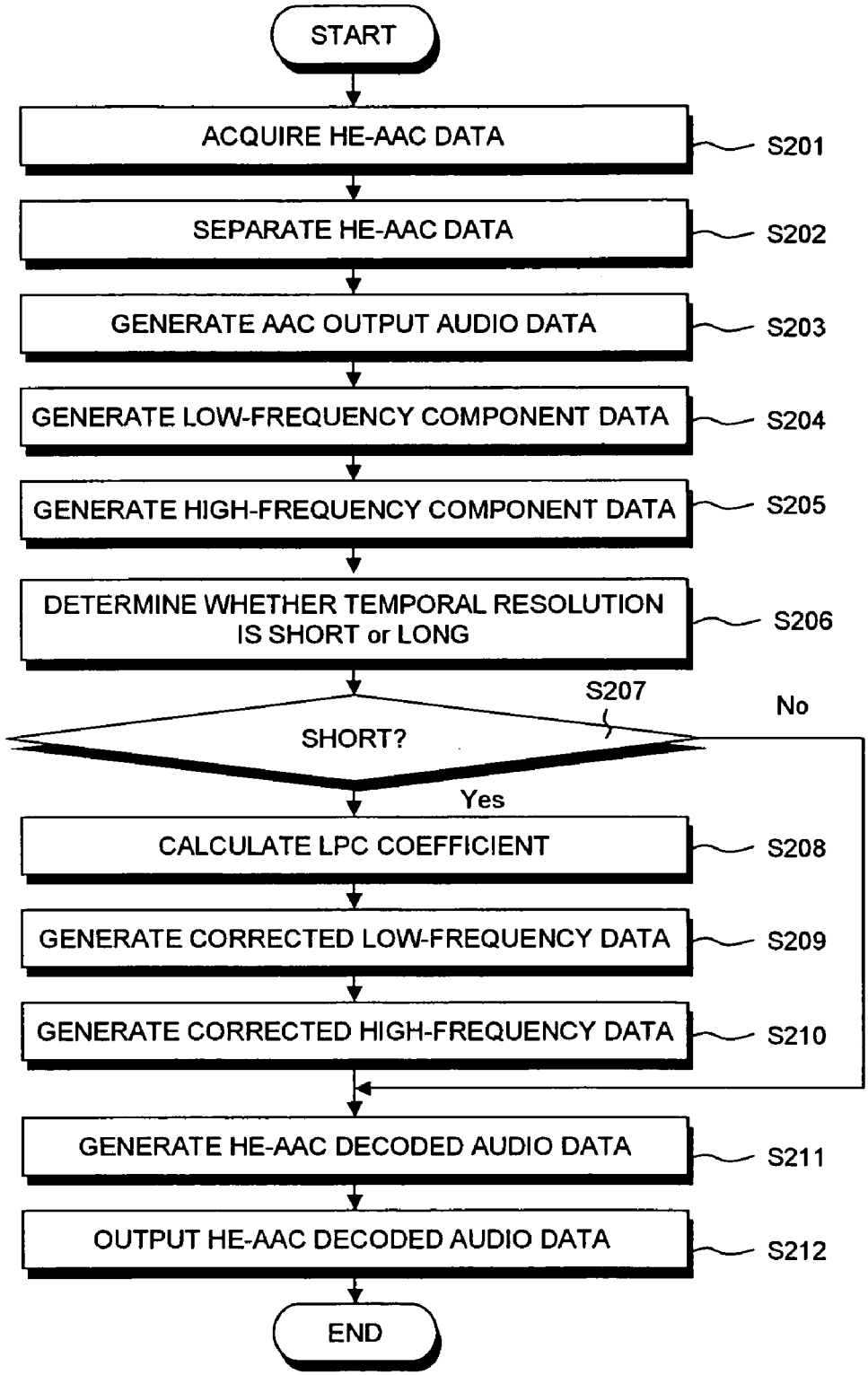
FIG. 10 is a flowchart illustrating a processing procedure performed in a decoder according to the second embodiment of the present invention.

Now, a processing procedure performed in the decoder 200 according to the second embodiment is described. FIG. 10 is a flowchart illustrating a processing procedure performed in the decoder 200 according to the second embodiment of the present invention. As illustrated in FIG. 10, in the decoder 200, the data separation section 210 acquires HE-AAC data (step S201), and separates the HE-AAC data into AAC data and SBR data (step S202).

Then, the AAC decoding section 220 generates AAC output audio data from the AAC data (step S203) The analysis filter section 230 generates low-frequency component data from the AAC output audio data (step S204). The high-frequency generation section 240 generates high-frequency component data from the SBR data and the low-frequency component data (step S205).

The transient characteristic detection section 250 determines whether a temporal resolution is the SHORT or the LONG based on window switch data (step S206). If the transient characteristic detection section 250 determines that the temporal resolution is the LONG (step S207: NO), the processing proceeds to step S211.

On the other hand, if the transient characteristic detection section 250 determines that the temporal resolution is the SHORT (step S207: YES), the stationarity removing section 260 performs an LPC analysis on the low-frequency component data, and calculates an LPC coefficient (step S208). The stationarity removing section 260 generates corrected low-frequency data based on the calculated LPC coefficient (step S209).

The high-frequency correction section 270 corrects the high-frequency component data and generates corrected high-frequency data (step S210). The synthesis filter section 280 synthesizes the low-frequency component data with the corrected high-frequency data, generates HE-AAC decoded audio data (step S211), and outputs the HE-AAC decoded audio data (step S212).

As described above, the transient characteristic detection section 250 determines whether HE-AAC data has transient characteristics or not based on window switch data. Accordingly, it is possible to reduce processing loads in the transient characteristic determination.

As described above, in the decoder 200 according to the second embodiment, the transient characteristic detection section 250 determines whether HE-AAC contains an attack sound based on window switch data. If the transient characteristic detection section 250 determines that the HE-AAC data contains the attack sound, the stationarity removing section 260 removes a stationary component contained in the low-frequency component data. Then, the high-frequency correction section 270 generates corrected high-frequency data that is data whose high-frequency component data is corrected to match with a duration of the corrected low-frequency component data. Further, the synthesis filter section 280 synthesizes the low-frequency component data with the corrected high-frequency data and generates HE-AAC decoded audio data. Accordingly, it is possible to reduce the processing loads in the transient characteristic determination. Further, if an audio signal that contains a sound source that has strong transient characteristics such as an attack sound is decoded, it can be prevented that the attack sound temporally extends, and deterioration in the sound quality of the audio signal can be prevented.

Third Embodiment

Now, a decoder according to a third embodiment of the present invention is described. If HE-AAC data (audio signal) contains an attack sound, depending on a position of the attack sound, a prediction gain in an PLC analysis may not be enough, and a stationary component in low-frequency component data may not be adequately removed. To solve the problem, the decoder according to the third embodiment divides a frame in the low-frequency component data into two sub-frames. Then, the decoder calculates LPC coefficients in the respective sub frames, the LPC coefficients are different from each other, and removes the stationary component in the low-frequency component data.

Figure 11:
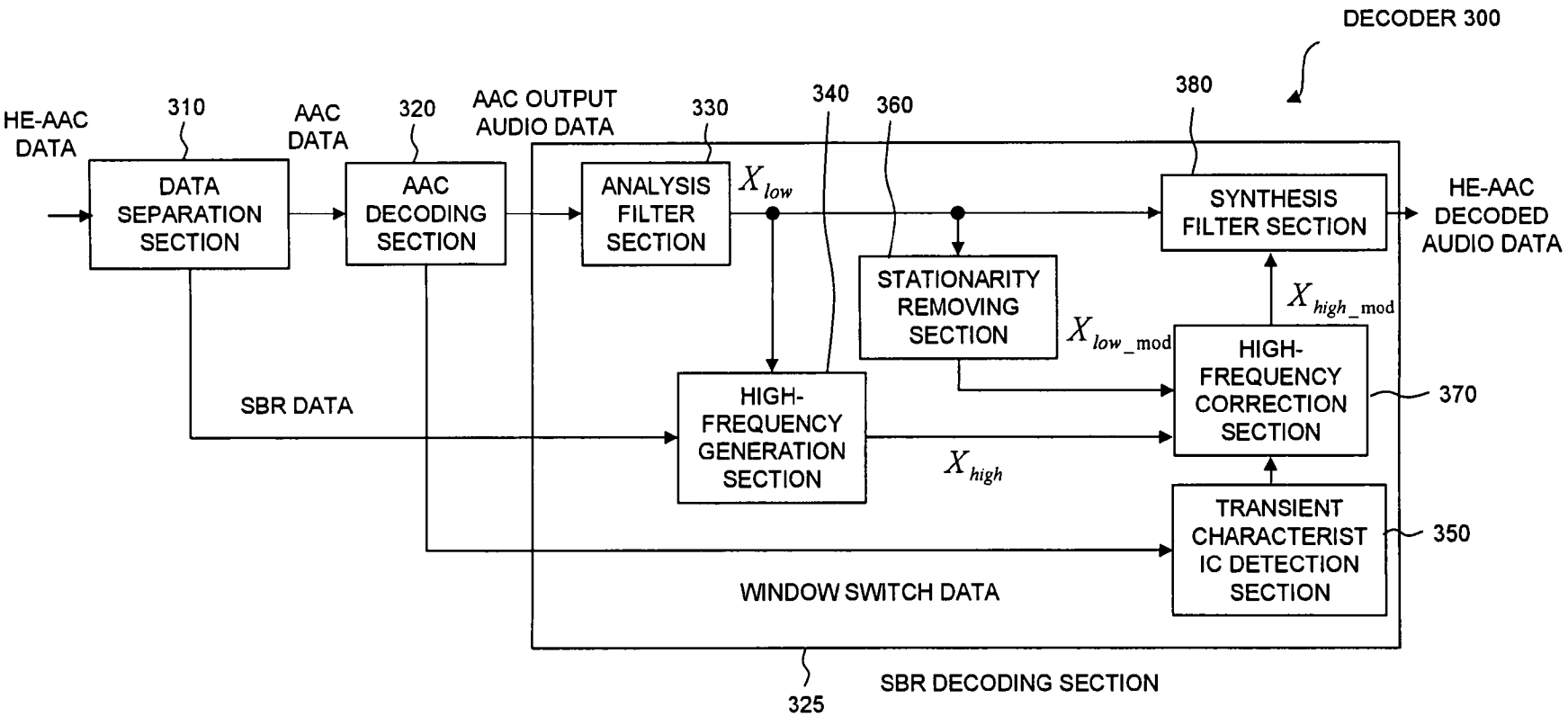
FIG. 11 is a view illustrating a configuration of a decoder according to a third embodiment of the present invention.

FIG. 11 is a view illustrating a configuration of a decoder 300 according to the third embodiment of the present invention. As illustrated in FIG. 11, the decoder 300 includes a data separation section 310, an AAC decoding section 320, and an SBR decoding section 325. The SBR decoding section 325 includes an analysis filter section 330, a high-frequency generation section 340, a transient characteristic detection section 350, a stationarity removing section 360, a high-frequency correction section 370, and a synthesis filter section 380.

Since the data separation section 310, the analysis filter section 330, the high-frequency generation section 340, the high-frequency correction section 370, and the synthesis filter section 380 are similar to the data separation section 110, the analysis filter section 130, the high-frequency generation section 140, the high-frequency correction section 170, and the synthesis filter section 180 illustrated in FIG. 2, their descriptions are omitted. Further, since the AAC decoding section 320 and the transient characteristic detection section 350 are similar to the AAC decoding section 220 and the transient characteristic detection section 250 illustrated in FIG. 9, their descriptions are omitted.

The stationarity removing section 360 is a processing section that divides a frame in low-frequency component data acquired from the analysis filter section 330 into two sub-frames. Then, the stationarity removing section 360 calculates LPC coefficients in the respective sub-frames, the LPC coefficients are different from each other, and generates corrected low-frequency data by removing stationary components in the low-frequency component data based on each LPC coefficient.

Figure 12:
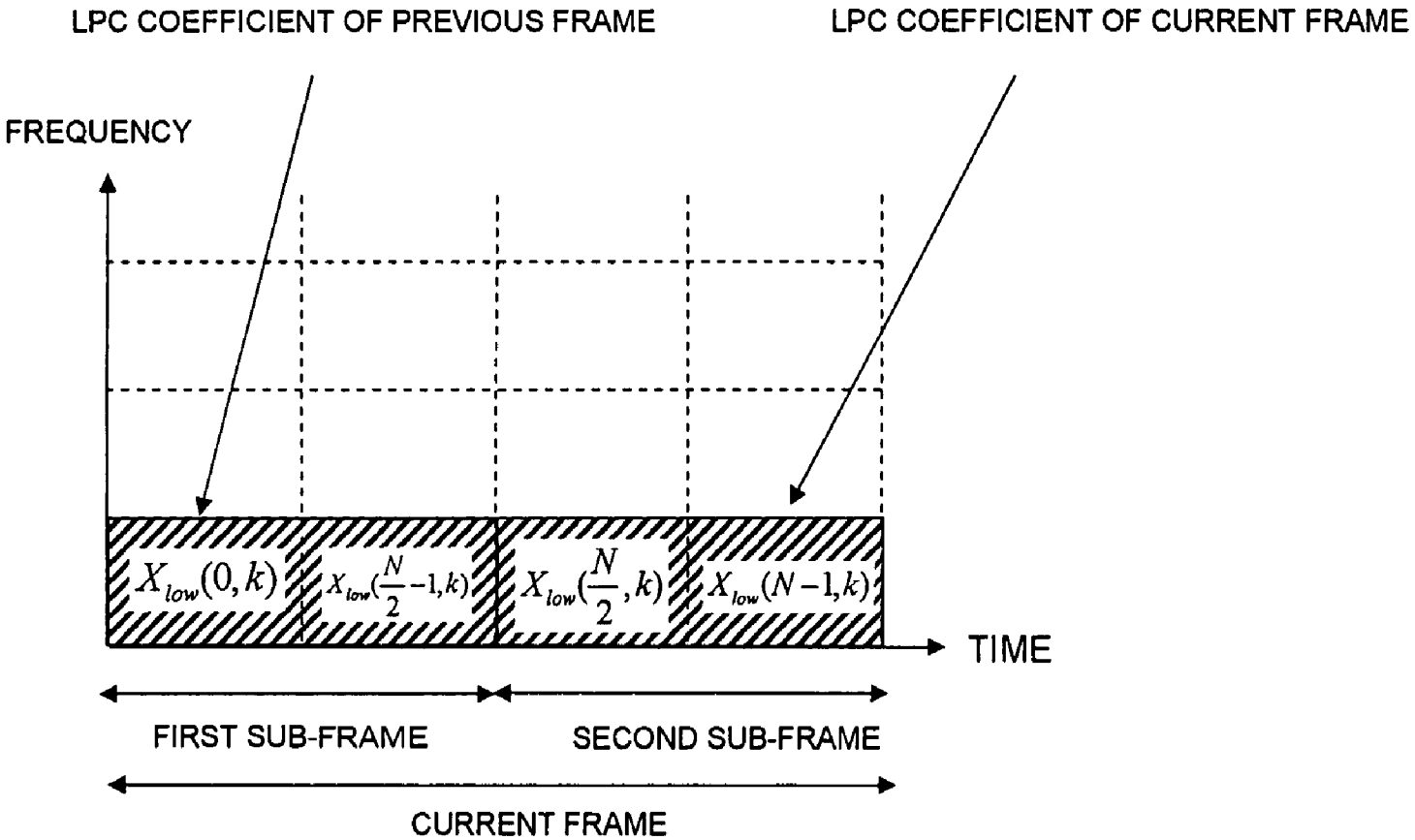
FIG. 12 is a view illustrating a processing performed in a stationarity removing section according to the third embodiment of the present invention.

FIG. 12 is a view illustrating a processing performed in the stationarity removing section 360 according to the third embodiment of the present invention. When a current frame (frame in the low-frequency component data) is acquired, as illustrated in FIG. 12, the stationarity removing section 360 divides the current frame into a first sub-frame and a second sub-frame.

Then, the stationarity removing section 360, to the first sub-frame, generates a first residual signal by removing a stationary component from the first sub-frame using an LPC coefficient calculated in a previous frame (last frame acquired before the current frame). In order to calculate the residual signal using the LPC coefficient, low-frequency component data $X_{low}(0, k)$ to $X_{low}(N/2-1, k)$ (see FIG. 12) and the LPC coefficient of the previous frame are to be substituted into the equation (1) and the equation (2).

The stationarity removing section 360, to the second sub-frame, generates a second residual signal from which a stationary component in the second sub-frame is removed by calculating an LPC coefficient in the current frame to low-frequency component data $X_{low}(N/2, k)$ to $X_{low}(N-1, k)$ in the current frame (see FIG. 12) and substituting the LPC coefficient of the current frame and the low-frequency component data $X_{low}(N/2, k)$ to $X_{low}(N-1, k)$ into the equation (1) and the equation (2).

The stationarity removing section 360 performs the above-described processing to all frequency bands in the low-frequency component data. A combination of the first residual signal and the second residual signal is to be corrected low-frequency data from which a stationary component is removed from the low-frequency component data. As described above, by removing a stationary component from divided first sub-frame and second sub-frame, even if a position of an attack sound is not at the first or the last of the frame (for example, at a center of the frame), an adequate prediction gain can be ensured. Accordingly, the stationarity of the low-frequency component data can be adequately removed.

Figure 13:
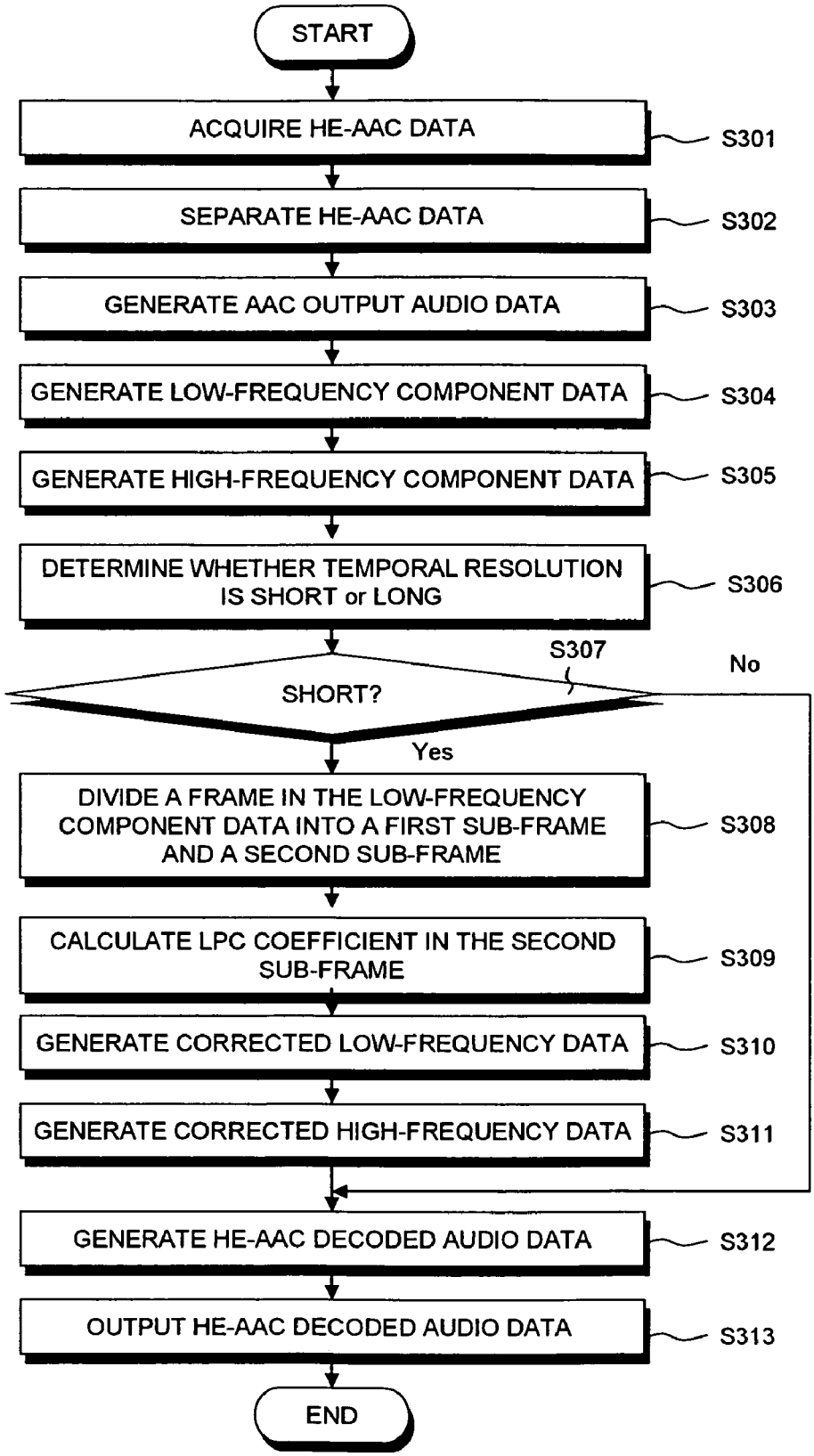
FIG. 13 is a flowchart illustrating a processing procedure performed in a decoder according to the third embodiment of the present invention.

Now, a processing procedure performed in the decoder 300 according to the third embodiment of the present invention is described. FIG. 13 is a flowchart illustrating a processing procedure performed in the decoder 300 according to the third embodiment of the present invention. As illustrated in FIG. 13, in the decoder 300, the data separation section 310 acquires HE-AAC data (step S301), and divides the HE-AAC data into AAC data and SBR data (step S302).

Then, the AAC decoding section 320 generates AAC output audio data from the AAC data (step S303). The analysis filter section 330 generates low-frequency component data from the AAC output audio data (step S304). The high-frequency generation section 340 generates high-frequency component data from the SBR data and the low-frequency component data (step S305).

The transient characteristic detection section 350 determines whether a temporal resolution is the SHORT or the LONG based on window switch data (step S306). If the transient characteristic detection section 350 determines that the temporal resolution is the LONG (step S307: NO), the processing proceeds to step S312.

On the other hand, if the transient characteristic detection section 350 determines that the temporal resolution is the SHORT (step S307: YES), the stationarity removing section 360 divides a frame in the low-frequency component data into a first sub-frame and a second sub-frame (step S308). Then, the transient characteristic detection section 360 performs an LPC analysis on the second sub-frame, calculates an LPC coefficient in the second sub-frame (step S309), and generates corrected low-frequency data (step S310). To calculate an LPC coefficient of the first sub-frame, an LPC coefficient of a previous frame is used.

The high-frequency correction section 370 corrects the high-frequency component data and generates corrected high-frequency data (step S311). The synthesis filter section 380 synthesizes the low-frequency component data with the corrected high-frequency data, generates HE-AAC decoded audio data (step S312), and outputs the HE-AAC decoded audio data (step S313).

As described above, stationarity removing section 360 divides a frame into the first sub-frame and the second sub-frame. In the first sub-frame, a stationary component is removed using an LPC coefficient of a previous frame. In the second sub-frame, the stationary component is removed using an LPC that is obtained as a result of an LPC analysis performed on the second sub-frame. Accordingly, it is possible to adequately remove the stationary component from the low-frequency component data wherever an attack sound exists.

As described above, in the decoder 300 according to the third embodiment, the transient characteristic detection section 350 determines whether HE-AAC data contains an attack sound based on window switch data. If the transient characteristic detection section 350 determines that the HE-AAC contains the attack sound, the stationarity removing section 360 divides a frame in the HE-AAC data into the first sub-frame and the second sub-frame, and removes a stationary component using LPC coefficients corresponding to each frame. Then, the high-frequency correction section 370 generates corrected high-frequency data that is data whose high-frequency component data is corrected to match with a duration of the corrected low-frequency component data. Further, the synthesis filter section 380 synthesizes the low-frequency component data with the corrected high-frequency data and generates HE-AAC decoded audio data. Accordingly, it is possible to adequately remove the stationary component in the low-frequency component data. Further, if an audio signal that contains a sound source that has strong transient characteristics such as an attack sound is decoded, it can be prevented that the attack sound temporally extends, and deterioration in the sound quality of the audio signal can be prevented.

Fourth Embodiment

Now, a decoder according to a fourth embodiment of the present invention is described. If a frame in low-frequency component data contains an attack sound, depending on a position (time) of the attack sound, a prediction gain in an PLC analysis may not be enough, and a stationary component in low-frequency component data may not be adequately removed. To solve the problem, the decoder according to the fourth embodiment detects the position of the attack sound in the frame, and divides the frame into a plurality of sub-frames based on the detected position. Then, the decoder performs a stationary removal using different LPC coefficients for the respective sub-frames.

As described above, the decoder according to the fourth embodiment detects the position of the attack sound in the frame in the low-frequency component data, and divides the frame into the plurality of sub-frames based on the detected position. Then, the decoder removes the stationary component using the different LPC coefficients for the respective sub-frames. Accordingly, it is possible to adequately remove the stationary component from the low-frequency component data wherever the attack sound exists.

Figure 14:
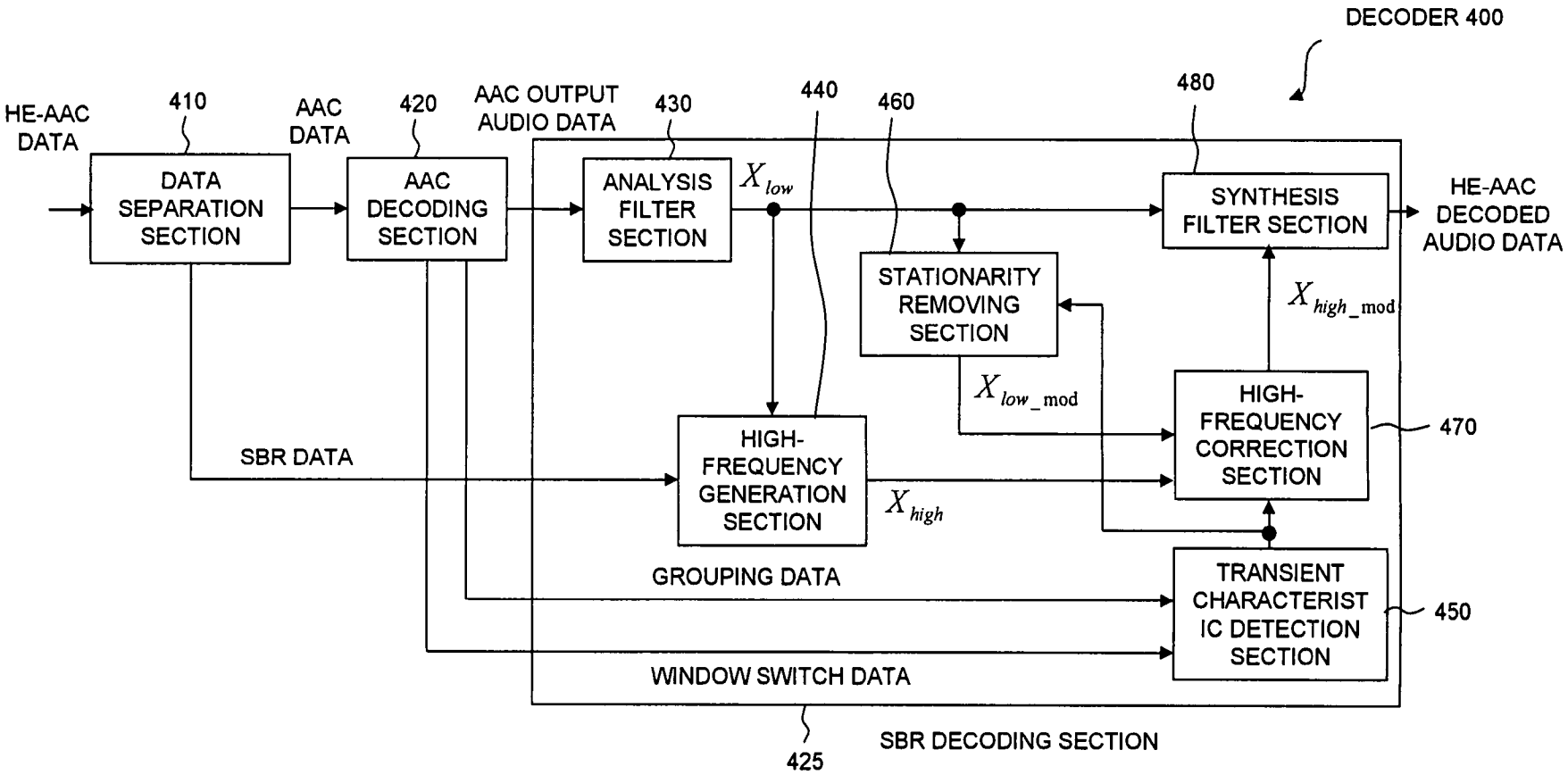
FIG. 14 is a view illustrating a configuration of a decoder according to a fourth embodiment of the present invention.

FIG. 14 is a view illustrating a configuration of a decoder 400 according to the fourth embodiment of the present invention. As illustrated in FIG. 14, the decoder 400 includes a data separation section 410, an AAC decoding section 420, and an SBR decoding section 425. The SBR decoding section 425 includes an analysis filter section 430, a high-frequency generation section 440, a transient characteristic detection section 450, a stationarity removing section 460, a high-frequency correction section 470, and a synthesis filter section 480.

Since the data separation section 410, the analysis filter section 430, the high-frequency generation section 440, the high-frequency correction section 470, and the synthesis filter section 480 are similar to the data separation section 110, the analysis filter section 130, the high-frequency generation section 140, the high-frequency correction section 170, and the synthesis filter section 180 illustrated in FIG. 2, their descriptions are omitted.

The AAC decoding section 420 decodes AAC data acquired from the data separation section 410, and outputs the decoded ACC output audio data to the analysis filter section 430. Further, the AAC decoding section 420 extracts window switch data and grouping data contained in the decoded AAC data, and outputs the window switch data and the grouping data to the transient characteristic detection section 450.

Figure 15:
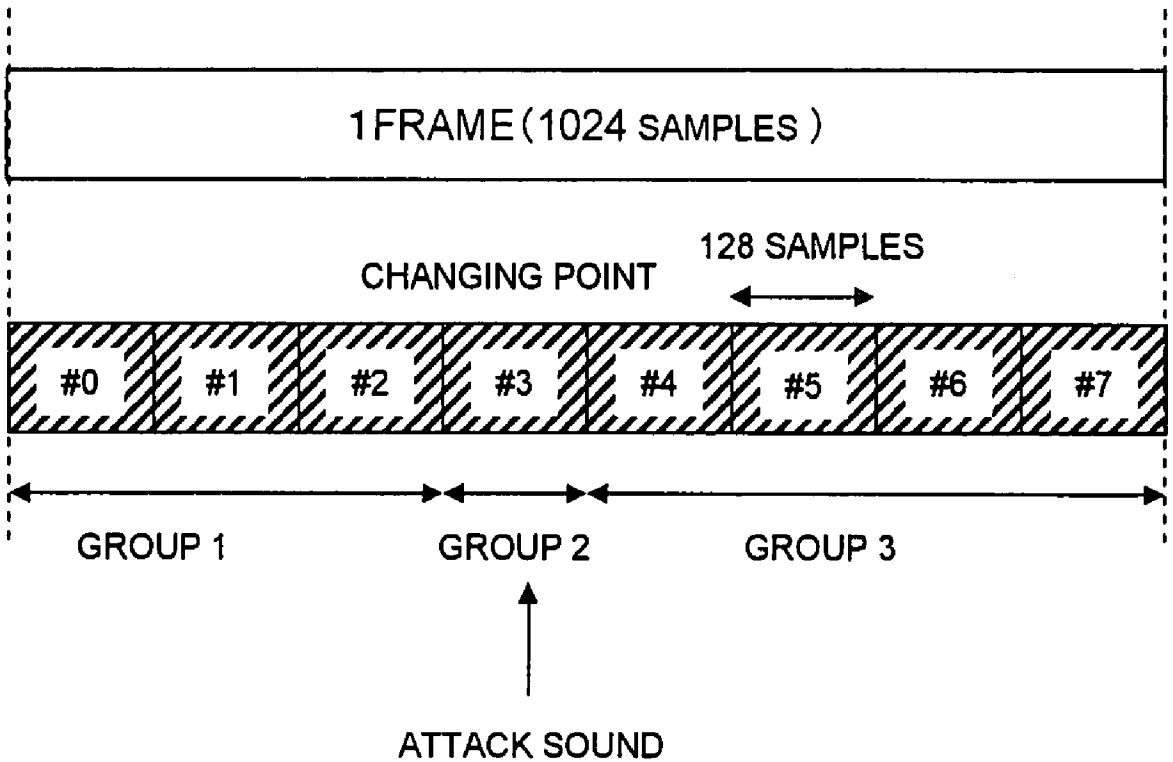
FIG. 15 is a view illustrating a grouping data.

The window switch data in the fourth embodiment is similar to that described in the second embodiment. The grouping data is used to detect a position of an attack sound. In the AAC, if the SHORT is set to the window switch data, further, one frame is divided into eight sub-frames. The grouping data indicates how to divide the frame. FIG. 15 is a view illustrating the grouping data.

For example, in FIG. 15, if a changing point exists at a position of #3 (if an attack sound exists at the position of #3), the grouping data considers only the #3 as one group (group 2), and considers preceding and following positions as the other groups (groups 1 and 3). Accordingly, using the grouping data, it is possible to determine that the attack sound exists at the changing point (in FIG. 15, #3).

The transient characteristic detection section 450 is a processing section that acquires window switch data and grouping data from the AAC decoding section 420, determines whether HE-AAC data has transient characteristics based on the acquired window switch data, and outputs the determination result to the high-frequency correction section 470. Further, if the transient characteristic detection section 450 determines that the HE-AAC has transient characteristics, based on the grouping data, the transient characteristic detection section 450 detects the position of the attack sound, and outputs information (hereinafter, referred to as attack sound position data) about the position of the attack sound to the stationarity removing section 460.

The stationarity removing section 460 is a processing section that divides a frame in low-frequency component data acquired from the analysis filter section 430 based on a position of an attack sound, calculates LPC coefficients in the respective sub-frames, the LPC coefficients are different from each other, and generates corrected low-frequency data by removing a stationary component in the low-frequency component data based on each LPC coefficient.

Figure 16:
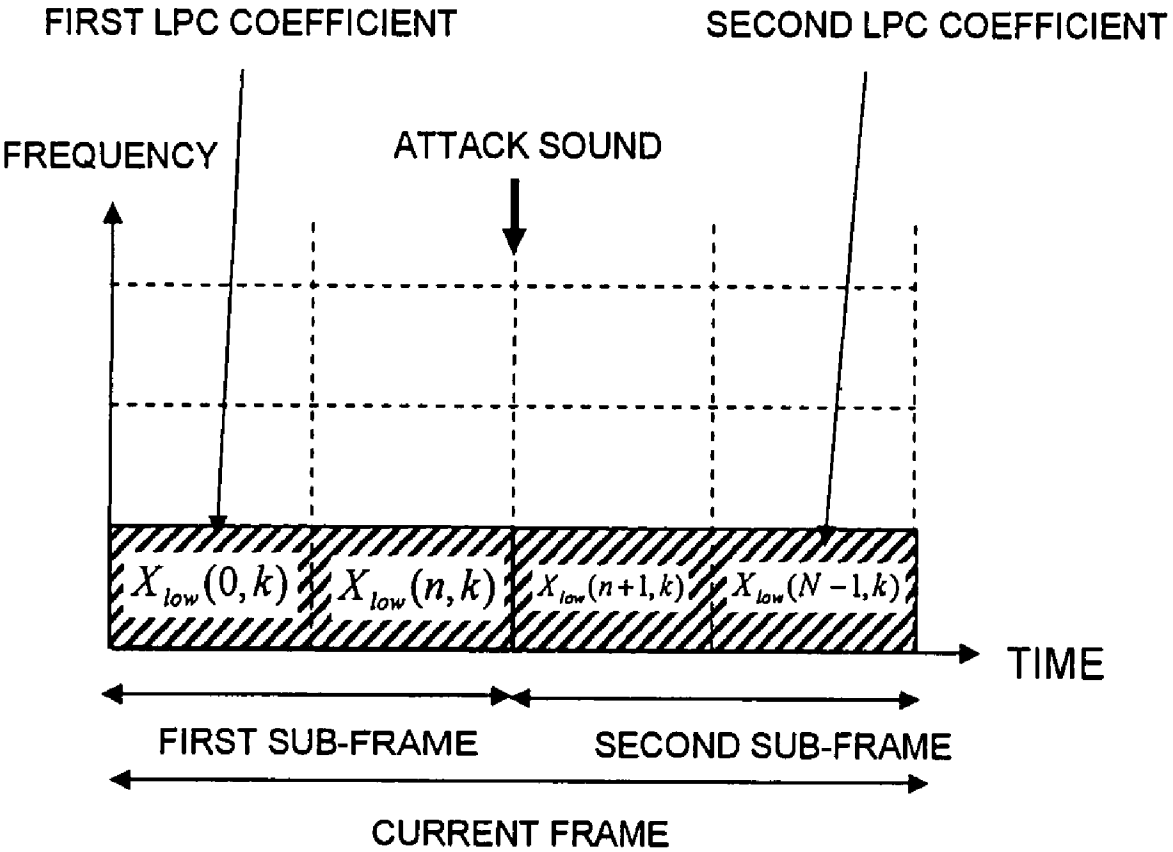
FIG. 16 is a view illustrating a processing performed in a stationarity removing section according to the fourth embodiment of the present invention.

FIG. 16 is a view illustrating a processing performed in the stationarity removing section 460 according to the fourth embodiment of the present invention. The stationarity removing section 460 acquires attack sound position data from the transient characteristic detection section 450, and divides a current frame (frame in the low-frequency component data) into two sub-frames (first sub-frame and second sub-frame) at before and after the attack sound.

Then, the stationarity removing section 460, to the first sub-frame, with respect to low-frequency component data $X_{low}(0,k)$ to $X_{low}(n,k)$ in a current frame, calculates an LPC coefficient in the current frame. Then, the stationarity removing section 460 generates a first residual signal by removing a stationary component from the first sub-frame by substituting the calculated LPC coefficient and low-frequency component data $X_{low}(0, k)$ to $X_{low}(n, k)$ into the equation (1) and the equation (2).

Then, the stationarity removing section 460, to the second sub-frame, with respect to low-frequency component data $X_{low}(n+1,k)$ to $X_{low}(N-1,k)$ in a current frame, calculates an LPC coefficient in the current frame. Then, the stationarity removing section 460 generates a second residual signal by removing a stationary component from the second sub-frame by substituting the calculated LPC coefficient and the low-frequency component data $X_{low}(n+1, k)$ to $X_{low}(N-1,k)$ into the equation (1) and the equation (2).

The stationarity removing section 460 performs the above-described processing to all frequency bands in the low-frequency component data. A combination of the first residual signal and the second residual signal is to be corrected low-frequency data from which the stationary component is removed from the low-frequency component data. As described above, by removing the stationary component from the divided first sub-frame and second sub-frame, even if the position of the attack sound varies, an adequate prediction gain can be ensured. Accordingly, the stationarity of the low-frequency component data can be adequately removed.

In the fourth embodiment, the stationarity removing section 460 divides a frame into two sub-frames at before and after an attack sound. However, it is possible to divide the frame into three or more sub-frames, calculate LPC coefficients for each sub-frame, and remove a stationary component.

Figure 17:
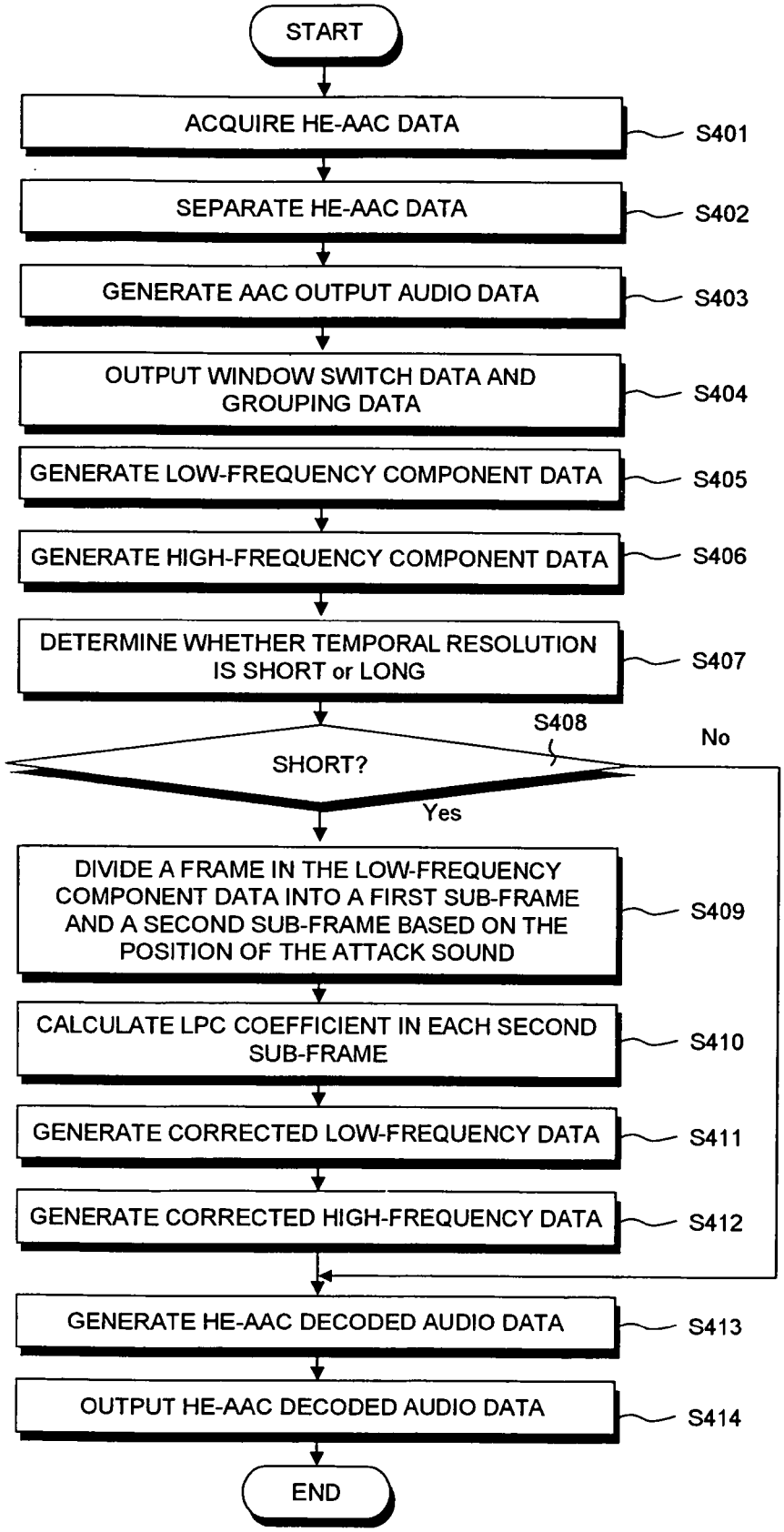
FIG. 17 is a flowchart illustrating a processing procedure performed in a decoder according to the fourth embodiment of the present invention.

Now, a processing procedure performed in the decoder 400 according to the fourth embodiment of the present invention is described. FIG. 17 is a flowchart illustrating a processing procedure performed in the decoder 400 according to the fourth embodiment of the present invention. As illustrated in FIG. 17, in the decoder 400, the data separation section 410 acquires HE-AAC data (step S401), and divides the HE-AAC data into AAC data and SBR data (step S402).

Then, the AAC decoding section 420 generates AAC output audio data from the AAC data (step S403), and outputs window switch data and grouping data (step S404). The analysis filter section 430 generates low-frequency component data from the AAC output audio data (step S405).

The high-frequency generation section 440 generates high-frequency component data from the SBR data and the low-frequency component data (step S406). The transient characteristic detection section 450 determines whether a temporal resolution is the SHORT or the LONG based on the window switch data (step S407). If the transient characteristic detection section 450 determines that the temporal resolution is the LONG (step S408: NO), the processing proceeds to step S413.

On the other hand, if the transient characteristic detection section 450 determines that the temporal resolution is the SHORT (step S408: YES), the stationarity removing section 460 divides a frame in the low-frequency component data into a first sub-frame and a second sub-frame based on the position of the attack sound (step S409). Then, the transient characteristic detection section 460 performs LPC analyses on each sub-frame, calculates LPC coefficients in each second sub-frame (step S410), and generates corrected low-frequency data (step S411).

The high-frequency correction section 470 corrects the high-frequency component data and generates corrected high-frequency data (step S412). The synthesis filter section 480 synthesizes the low-frequency component data with the corrected high-frequency data, generates HE-AAC decoded audio data (step S413), and outputs the HE-AAC decoded audio data (step S414).

As described above, the stationarity removing section 460 divides a frame into the first sub-frame and the second sub-frame based on a position of an attack sound, and a stationary component is removed using different LPC coefficients for each sub-frame. Accordingly, it is possible to adequately remove the stationary component wherever the attack sound exists.

As described above, if HE-AAC data contains an attack sound, in the decoder 400 according to the fourth embodiment, the stationarity removing section 460 divides low-frequency component data into the first sub-frame and the second sub-frame based on a position of the attack sound, and removes a stationary component using LPC coefficients corresponding to each frame. Then, the high-frequency correction section 470 generates corrected high-frequency data that is data whose high-frequency component data is corrected to match with a duration of the corrected low-frequency component data. The synthesis filter section 480 synthesizes the low-frequency component data with the corrected high-frequency data and generates HE-AAC decoded audio data. Accordingly, it is possible to adequately remove the stationary component in the low-frequency component data wherever the attack sound exists. Further, if an audio signal that contains a sound source that has strong transient characteristics such as an attack sound is decoded, it can be prevented that the attack sound temporally extends, and deterioration in the sound quality of the audio signal can be prevented.

In the above-described first to fourth embodiments, using the LPC inverse filter (short-term prediction inverse filter), a stationary component contained in low-frequency component data is removed. However, it is not limited to the above, for example, a long-term prediction inverse filter can be used instead of the LPC inverse filter. Further, the stationary component in the low-frequency component data can be removed by a combination of the LPC inverse filter and the long-term prediction inverse filter.

In the processings described in the above embodiments, all or a part of the processings that have been described to be automatically performed can be manually performed. Further, all or a part of the above-described processings to be manually performed can be automatically performed using a known method. Further, the processing procedures, the control procedures, the specific names, the various data, the information including parameters described in the above descriptions and drawings can be changed if not otherwise specified.

Further, each structural element in the decoders 100 to 400 illustrated in FIGS. 2, 9, 11, and 14 are described in a functional concept. Accordingly, it is not necessary to physically configure the structural elements as illustrated in the drawings. That is, specific embodiments in distribution and integration of each section are not limited to the illustrated embodiments, all or a part of the sections can be functionally or physically distributed or integrated in any unit depending on various loads and usage conditions. Further, all or a part of each processing function performed in each section can be realized by a central processing unit (CPU) and a program that is analyzed and implemented in the CPU, or hardware by a wired logic.

Figure 18:
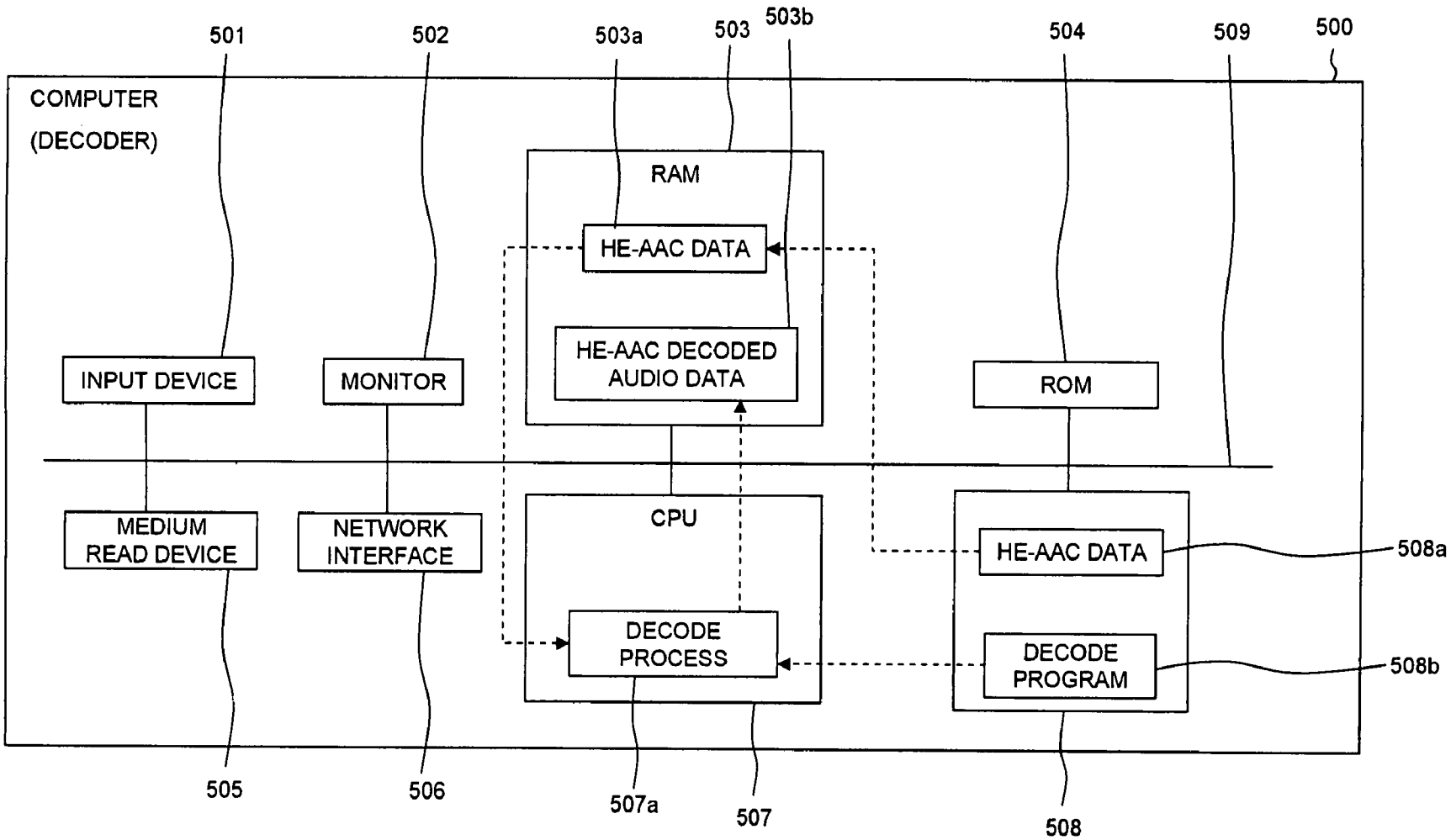
FIG. 18 is a flowchart illustrating a hardware configuration of a computer that forms the decoders according to the first to fourth embodiments of the present invention.
Figure 19:
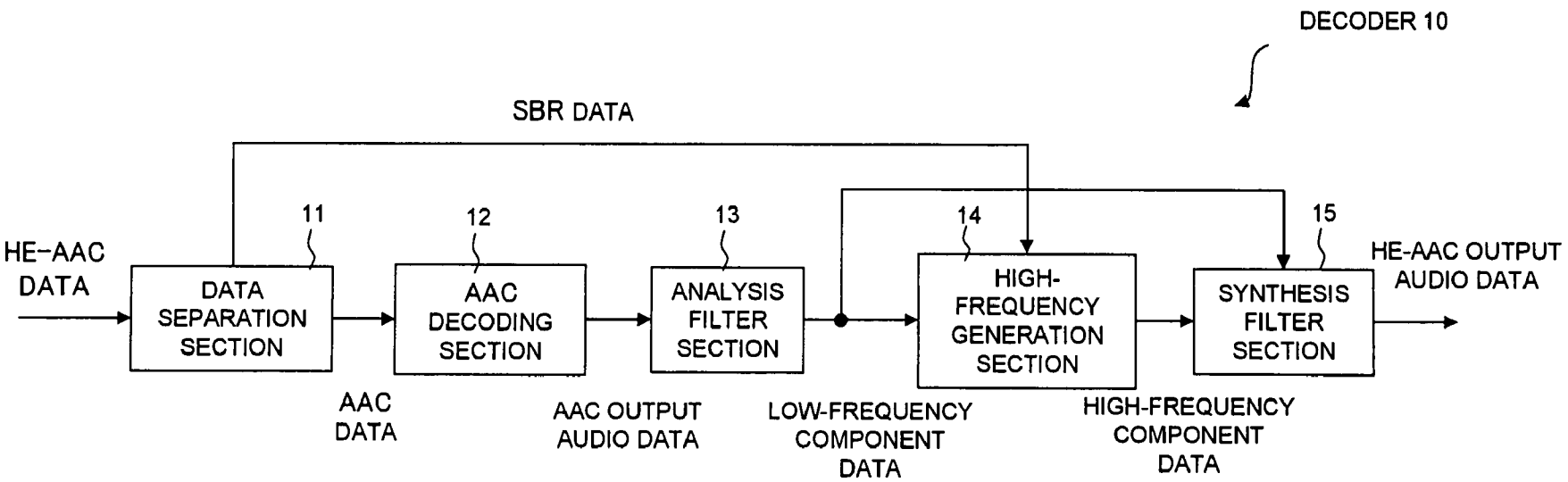
FIG. 19 is a functional block diagram illustrating a configuration of a known decoder.
Figure 20:
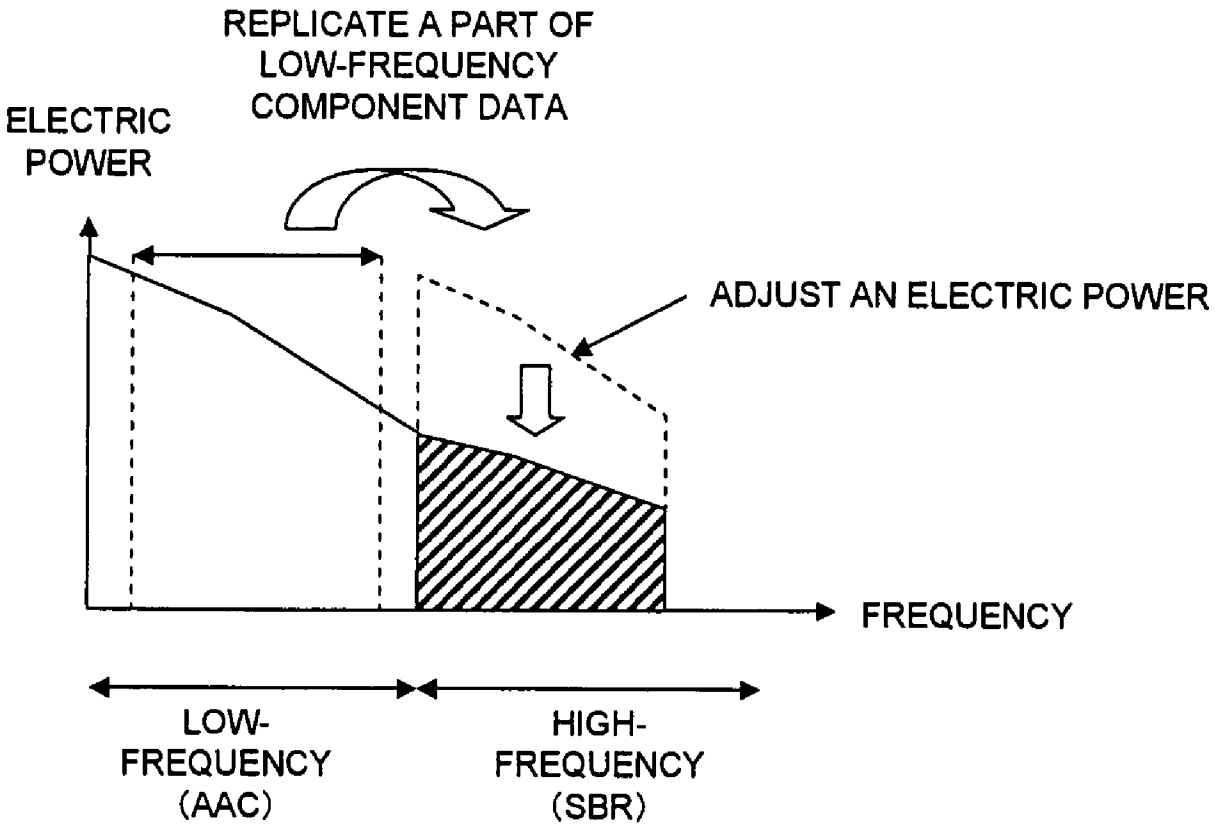
FIG. 20 is a view for outlining a processing performed in a decoder.

FIG. 18 is a flowchart illustrating a hardware configuration of a computer that forms the decoders according to the first to fourth embodiments of the present invention. As illustrated in FIG. 18, a computer (decoder) 500 includes an input device 501 that receives data such as HE-AAC data, a monitor 502, a random access memory (RAM) 503, a read only memory (ROM) 504, a medium read device 505 that reads data from a storage medium, a network interface 506 that transmits/receives data to/from another device, a CPU 507, a hard disk drive (HDD), and a bus 509. These elements are connected by the bus 509. Furthermore, the computer (decoder) 500 includes a speaker for outputting the regenerated audio signal.

The HDD 508 stores a decode program 508*b* that performs similar functions to the above-described decoders 100 to 400. When the CPU 507 reads and executes the decode program 508*b*, a decode process 507*a* is initiated. The decode process 507*a* corresponds to the data separation sections 110, 210, 310, and 410, the AAC decoding sections 120, 220, 320, and 420, and the SBR decoding sections 125, 225, 325, and 425.

Further, the HDD 508 stores HE-AAC data 508*a* that is acquired by the input device 501, or the like. The CPU 507 reads the HE-AAC data 508*a* stored in the HDD 508 and stores the data in the RAM 503. The HDD 508 used the HE-AAC data 503*a* stored in the RAM 503 to decode, and store HE-AAC decoded audio data 503*b* in the RAM 503.

It is not necessary to store the decode program 508*b* illustrated in FIG. 18 in the HDD 508 in advance. For example, the decode program 508*b* can be stored in a "portable physical medium" such as a flexible disk (FD), a compact disc read only memory (CD-ROM), a Digital Versatile Disc (DVD), a magnetic optical disk, and normalized activity integrated circuit card (IC card) that are to be inserted into a computer, a "fixable physical medium" such as a HDD that is provided inside or outside of the computer, or "another computer (or server)" that is connected to the computer via a public line, the Internet, a local area network (LAN), or a wide area network (WAN). The computer can read the decode program 508*b* from these media and implement the program.

What is claimed is:

1. A method for regenerating an audio signal including a low frequency component and a high frequency component by decoding a coded data including a first coded data and a second coded data, the method comprising the steps of:

generating the low frequency component by decoding the first coded data in the coded data;

generating the high frequency component on the basis of the second coded data and the low frequency component;

determining whether the low frequency component has transient characteristics or not;

generating a low frequency correction component by removing a stationary component in the low frequency component when the audio signal has the transient characteristics;

generating a corrected high frequency component by correcting the high-frequency component on the basis of the duration of the low frequency correction component when the audio signal has the transient characteristics; and regenerating the audio signal by synthesizing the low frequency component with the corrected high-frequency component.

2. The method according to claim 1, wherein the low frequency correction component generation step performs an frequency analysis on the low frequency component and calculates an frequency coefficient in the low frequency component, and generates the low frequency correction component by removing the stationary component in the low frequency component on the basis of the calculated frequency coefficient.

3. The method according to claim 1, wherein the determination step calculates an average electric power on the basis of a first low frequency component in an audio signal acquired in the past, and compares an electric power in a second low frequency component in a newly acquired audio signal with the average electric power for determining whether an audio signal to be coded has transient characteristics or not.

4. The decoding method according to claim 1, wherein the low frequency component includes window switch data that indicates whether the audio signal has transient characteristics or not, and the determination step determines whether the audio signal has the transient characteristics or not on the basis of the window switch data.

5. The method according to claim 1, wherein the low frequency correction component generation step divides a frame constructing the low frequency component into a first sub-frame and a second sub-frame, removes a first stationary component included in the first sub-frame by using a first frequency coefficient obtained as a result of a frequency analysis performed on a frame in the past, and removes a second stationary component included in the second sub-frame by using a second frequency coefficient obtained as a result of an frequency analysis performed on the second sub-frame for generating the low frequency correction component.

6. The method according to claim 1, wherein the low frequency correction component generation step, when the audio signal has the transient characteristics, divides frame in the low frequency component into sub-frames before and after a position the sound having the transient characteristics, performs a frequency analysis on each divided sub-frame to calculate a frequency coefficient corresponding to each sub-frame, and corrects each sub-frame on the basis of the calculated frequency coefficient to generate the low frequency correction component by removing the stationary component included in the low frequency component.

7. An apparatus for regenerating an audio signal including a low frequency component and a high frequency component by decoding a coded data including a first coded data and a second coded data, the apparatus comprising:

a receiving unit for receiving the coded data;

a processor for performing a process of regenerating the audio signal comprising the steps of:

generating the low frequency component by decoding the first coded data in the coded data;

generating the high frequency component on the basis of the second coded data and the low frequency component;

determining whether the low frequency component has transient characteristics or not;

generating a low frequency correction component by removing a stationary component in the low frequency component when the audio signal has the transient characteristics;

generating a corrected high frequency component by correcting the high-frequency component on the basis of the duration of the low frequency correction component when the audio signal has the transient characteristics; and regenerating the audio signal by synthesizing the low frequency component with the corrected high-frequency component;

an output unit for outputting the regenerated audio signal.

8. The apparatus according to claim 7, wherein the processor performs an frequency analysis on the low frequency component and calculates an frequency coefficient in the low frequency component, and generates the low frequency correction component by removing the stationary component in the low frequency component on the basis of the calculated frequency coefficient.

9. The apparatus according to claim 7, wherein the processor calculates an average electric power on the basis of a first low frequency component in an audio signal acquired in the past, and compares an electric power in a second low frequency component in a newly acquired audio signal with the average electric power for determining whether an audio signal to be coded has transient characteristics or not.

10. The apparatus according to claim 7, wherein the low frequency component includes window switch data that indicates whether the audio signal has transient characteristics or not, and the processor determines whether the audio signal has the transient characteristics or not on the basis of the window switch data.

11. The apparatus according to claim 7, wherein the processor divides a frame constructing the low frequency component into a first sub-frame and a second sub-frame, removes a first stationary component included in the first sub-frame by using a first frequency coefficient obtained as a result of a frequency analysis performed on a frame in the past, and removes a second stationary component included in the second sub-frame by using a second frequency coefficient obtained as a result of an frequency analysis performed on the second sub-frame for generating the low frequency correction component.

12. The apparatus according to claim 7, wherein the processor, when the audio signal has the transient characteristics, divides frame in the low frequency component into sub-frames before and after a position the sound having the transient characteristics, performs a frequency analysis on each divided sub-frame to calculate a frequency coefficient corresponding to each sub-frame, and corrects each sub-frame on the basis of the calculated frequency coefficient to generate the low frequency correction component by removing the stationary component included in the low frequency component.

* * * * *